US010526746B2

(12) United States Patent
Kitayama et al.

(10) Patent No.: US 10,526,746 B2
(45) Date of Patent: Jan. 7, 2020

(54) CLOTHES DRYER

(71) Applicant: Samsung Electronics Co., Ltd, Gyeonggi-do (KR)

(72) Inventors: Naoki Kitayama, Kanagawa (JP); Eiji Wakizaka, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 84 days.

(21) Appl. No.: 15/575,337

(22) PCT Filed: Jun. 2, 2015

(86) PCT No.: PCT/KR2015/005536

§ 371 (c)(1),
(2) Date: Nov. 17, 2017

(87) PCT Pub. No.: WO2016/186235

PCT Pub. Date: Nov. 24, 2016

(65) Prior Publication Data

US 2018/0148885 A1 May 31, 2018

(30) Foreign Application Priority Data

May 19, 2015 (JP) ..... 2015-101667
Jun. 2, 2015 (KR) ..... 10-2015-0078064

(51) Int. Cl.
*D06F 58/24* (2006.01)
*D06F 58/02* (2006.01)
(Continued)

(52) U.S. Cl.
CPC ..... *D06F 58/24* (2013.01); *D06F 58/02* (2013.01); *D06F 58/206* (2013.01); *D06F 58/22* (2013.01)

(58) Field of Classification Search
CPC ..... D06F 58/24; D06F 58/02; D06F 58/206; D06F 58/22
(Continued)

(56) References Cited

U.S. PATENT DOCUMENTS 5,042,171 A * 8/1991 Obata ..... D06F 58/24 34/604
9,335,095 B2 * 5/2016 Bison ..... D06F 39/12
(Continued)

FOREIGN PATENT DOCUMENTS

EP 3023531 A1 * 5/2016 ..... D06F 58/24
EP 3023531 A1 5/2016
(Continued)

OTHER PUBLICATIONS

International Search Report dated Feb. 18, 2016 in connection with International Patent Application No. PCT/KR2015/005536.
(Continued)

*Primary Examiner* — Stephen M Gravini

(57) ABSTRACT

The clothes dryer of the present disclosure includes a circulation air flow path communicating with the drum, a condensed water storage chamber communicating with the circulation air flow path and a pump chamber communicating with the condensed water storage chamber. The communication path introduces air into at least one of the first circulation air flow path and the pump chamber to reduce the pressure of the pump chamber by introducing air into the pump chamber or to introduce air into the condensed water storage chamber through the first circulation air flow path. Accordingly, there is an effect of increasing the air volume of the fan device while preventing backflow and scattering of the condensed water caused by dehumidification in the clothes dryer.

20 Claims, 14 Drawing Sheets

(51) Int. Cl.
*D06F 58/20* (2006.01)
*D06F 58/22* (2006.01)

(58) Field of Classification Search
USPC ..... 34/76
See application file for complete search history.

(56) References Cited

U.S. PATENT DOCUMENTS

| | | | | |
|---|---|---|---|---|
| 9,617,680 | B2 * | 4/2017 | Kitayama | D06F 58/24 |
| 9,863,086 | B2 * | 1/2018 | Zhu | D06F 39/04 |
| 10,151,061 | B1 * | 12/2018 | Farrel | D06F 58/28 |
| 10,179,967 | B2 * | 1/2019 | Ozdemir | D06F 58/206 |
| 2012/0005912 | A1 | 1/2012 | Lee et al. | |
| 2013/0312274 | A1 * | 11/2013 | Pillot | D06F 58/24 34/73 |
| 2014/0013616 | A1 * | 1/2014 | Lee | F26B 21/086 34/524 |
| 2018/0148885 | A1 * | 5/2018 | Kitayama | D06F 58/02 |
| 2018/0245274 | A1 * | 8/2018 | Bocchino | D06F 58/22 |

FOREIGN PATENT DOCUMENTS

| | | | | |
|---|---|---|---|---|
| EP | 3173518 | A1 * | 5/2017 | F26B 21/086 |
| GB | 2121523 | A | 12/1983 | |
| JP | 2011194035 | A | 10/2011 | |
| KR | 10-1155236 | B1 | 6/2012 | |
| KR | 10-1158438 | B1 | 6/2012 | |
| KR | 10-1186159 | B1 | 10/2012 | |
| KR | 10-1208553 | B1 | 12/2012 | |
| KR | 10-2014-0010585 | A | 1/2014 | |
| WO | WO-2012093059 | A1 * | 7/2012 | D06F 39/12 |

OTHER PUBLICATIONS

Written Opinion of the International Searching Authority dated Feb. 18, 2016 in connection with International Patent Application No. PCT/KR2015/005536.

European Patent Office, "Communication under Rule 71(3) EPC," Application No. EP15892649.3, dated Jan. 29, 2019, 61 pages.

European Search Report dated Jun. 14, 2018 in connection with European Patent Application No. 15 89 2649.

* cited by examiner

[Fig. 1]
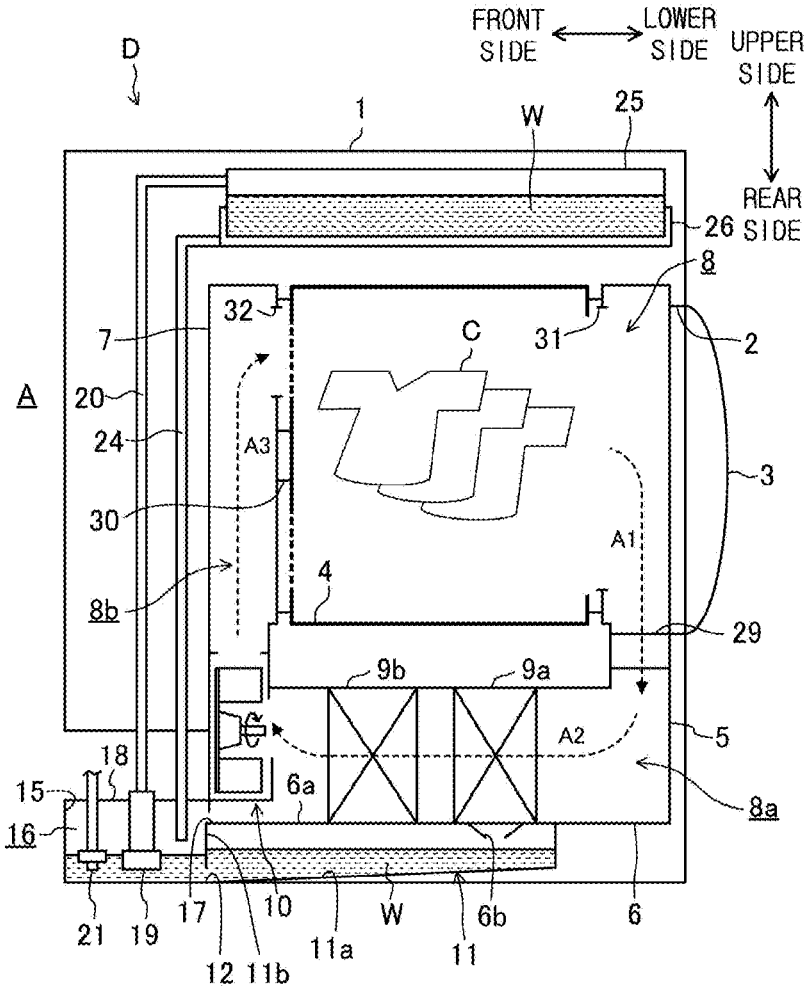

[Fig. 2]
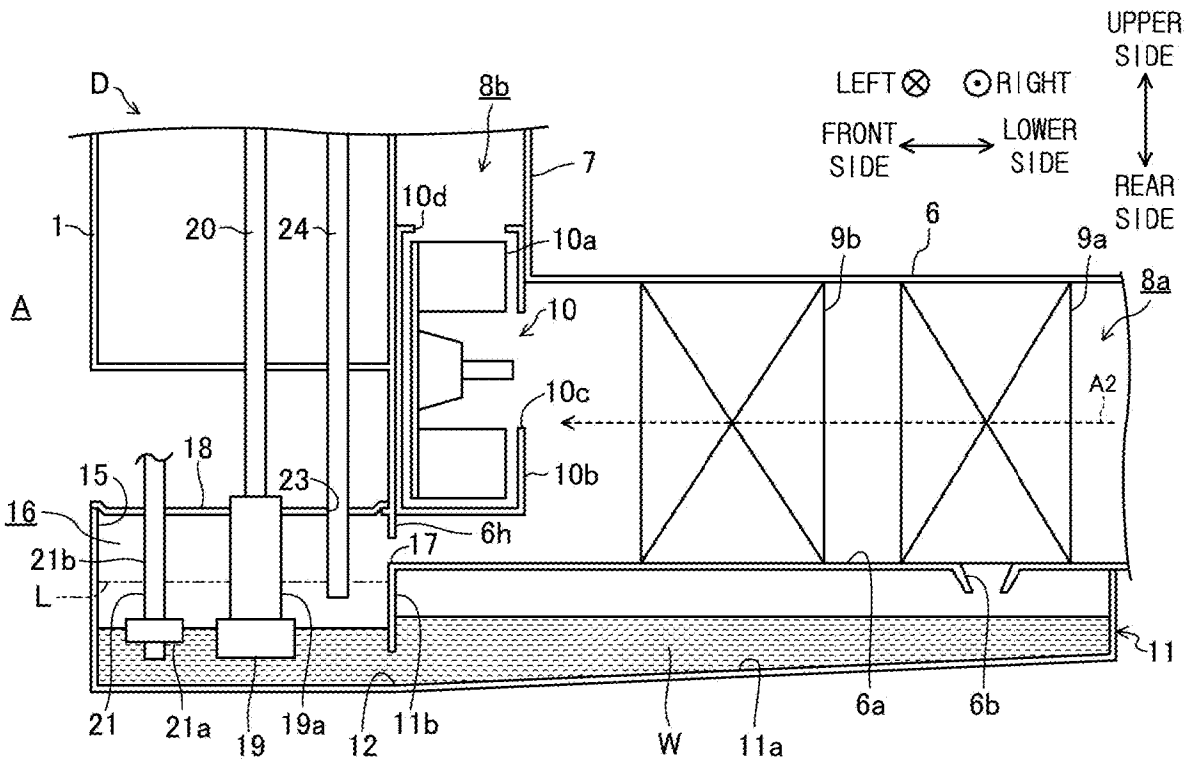

[Fig. 3]
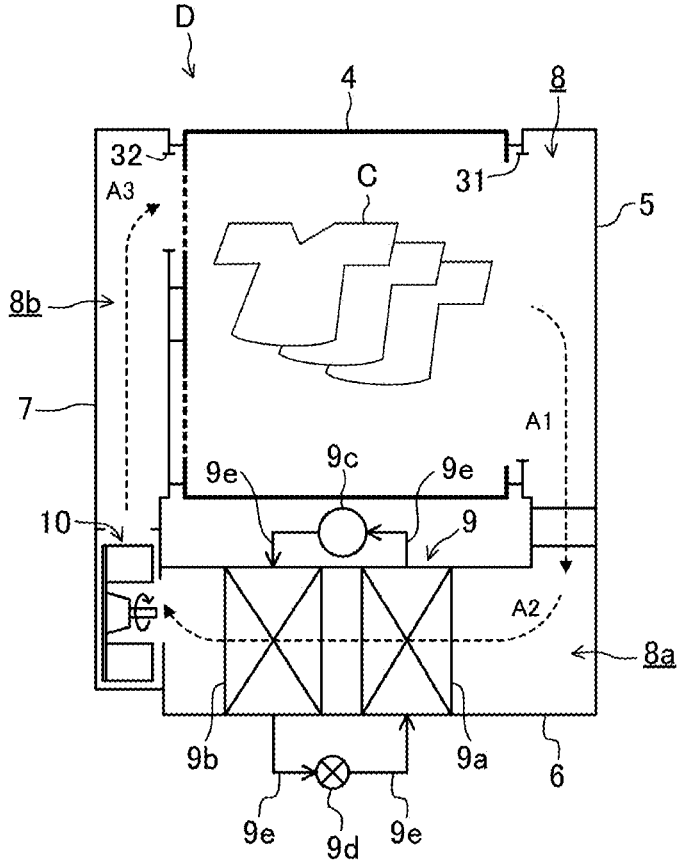
[Fig. 4a]
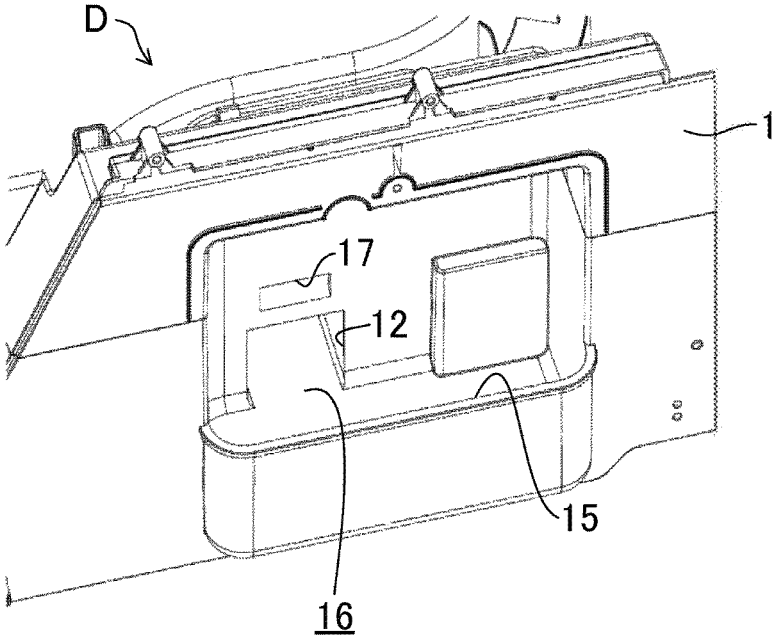

[Fig. 4b]
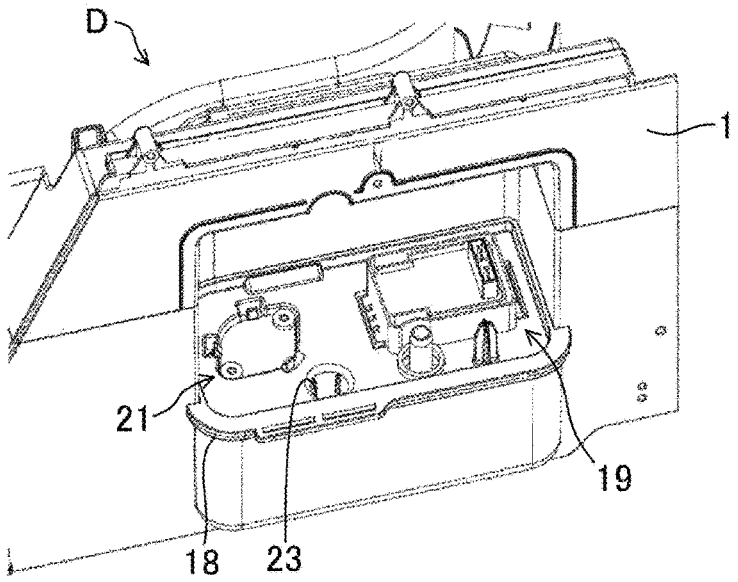
[Fig. 5]
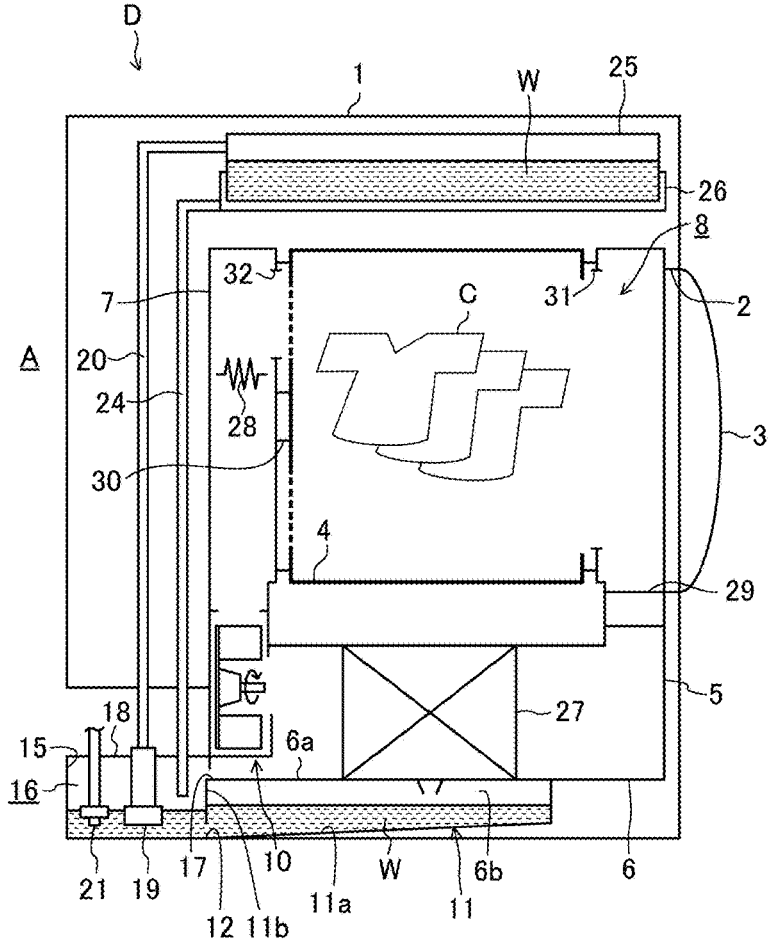

[Fig. 6]
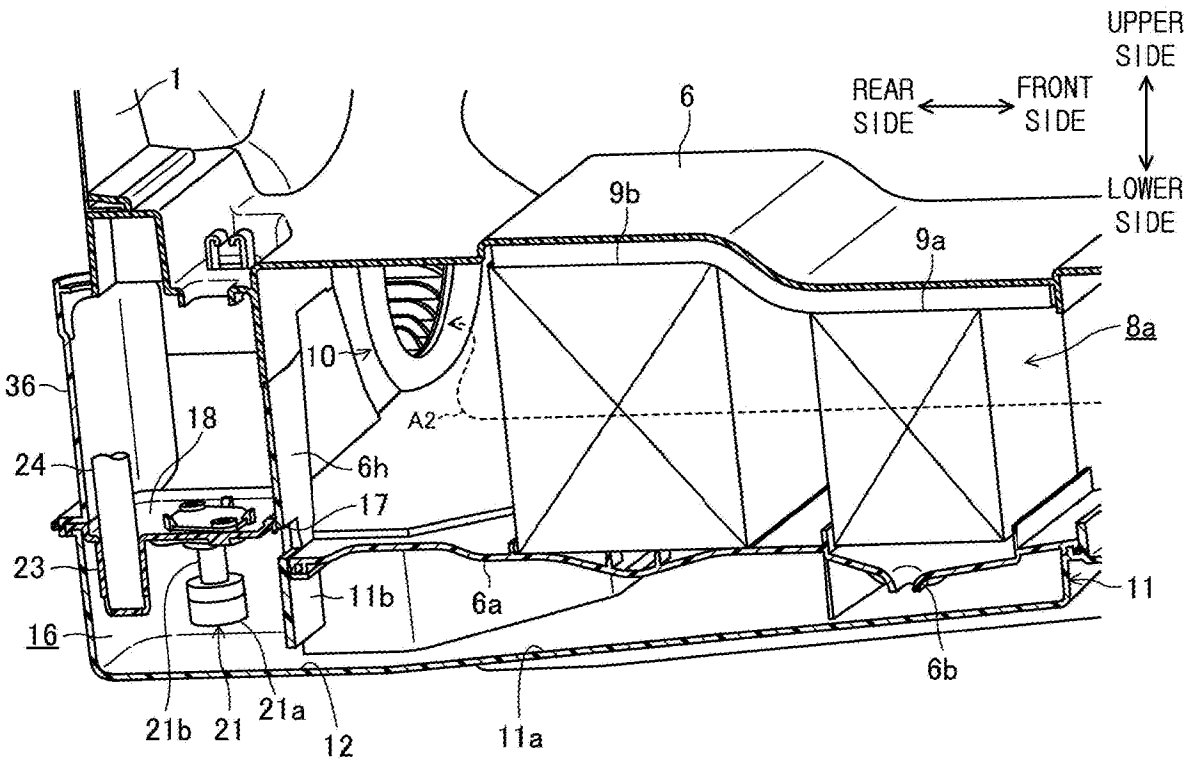

[Fig. 7]
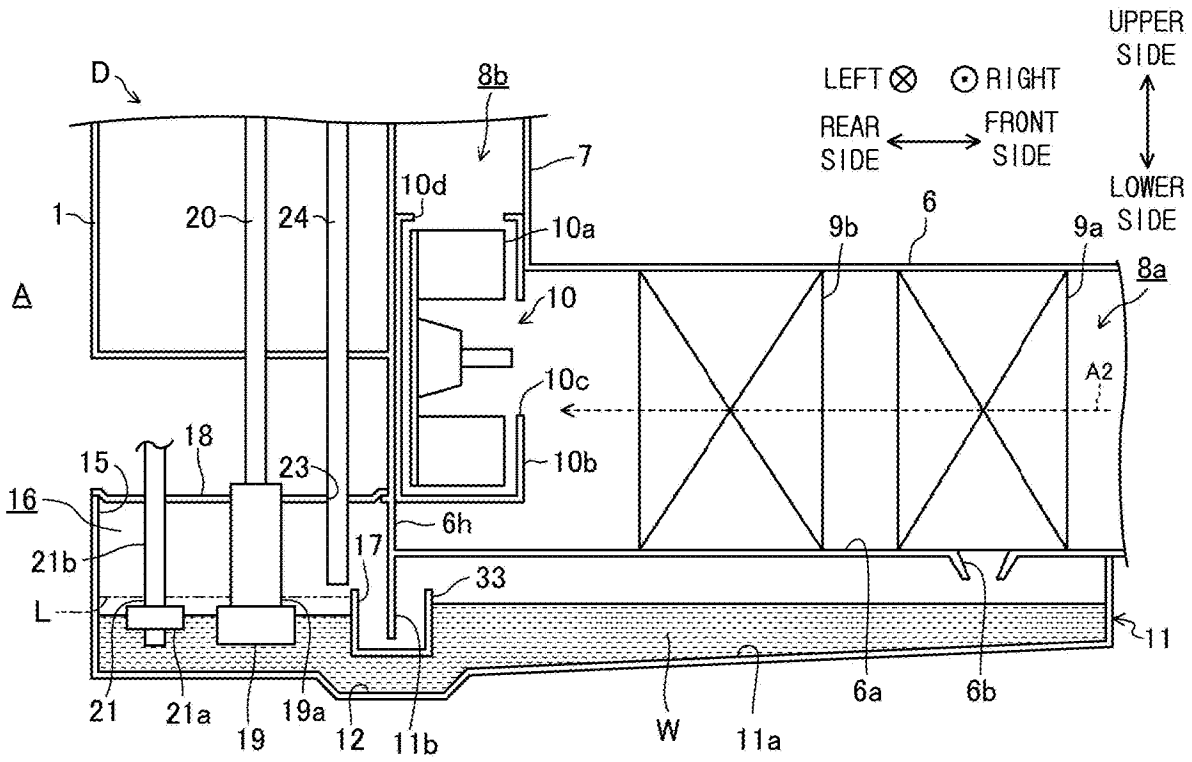

[Fig. 8a]
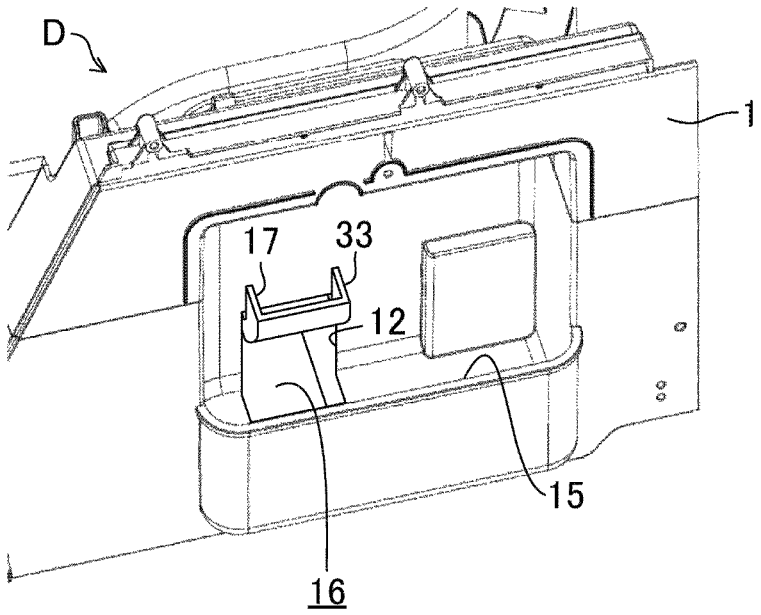
[Fig. 8b]
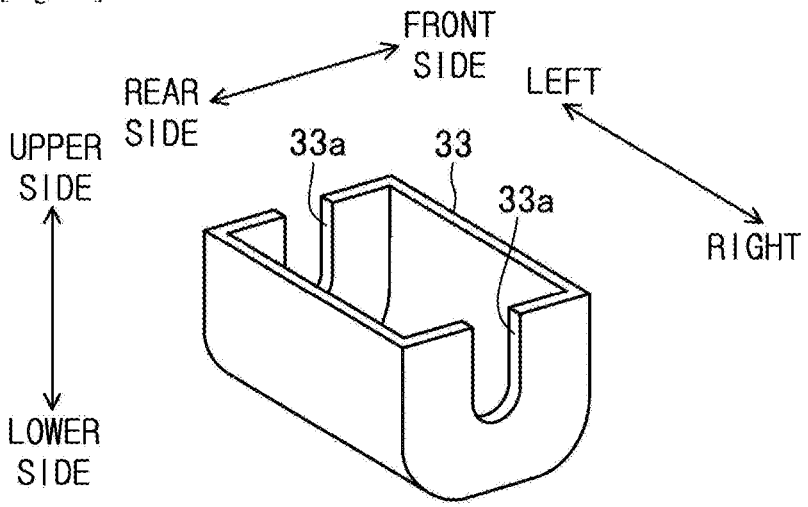

[Fig. 9]
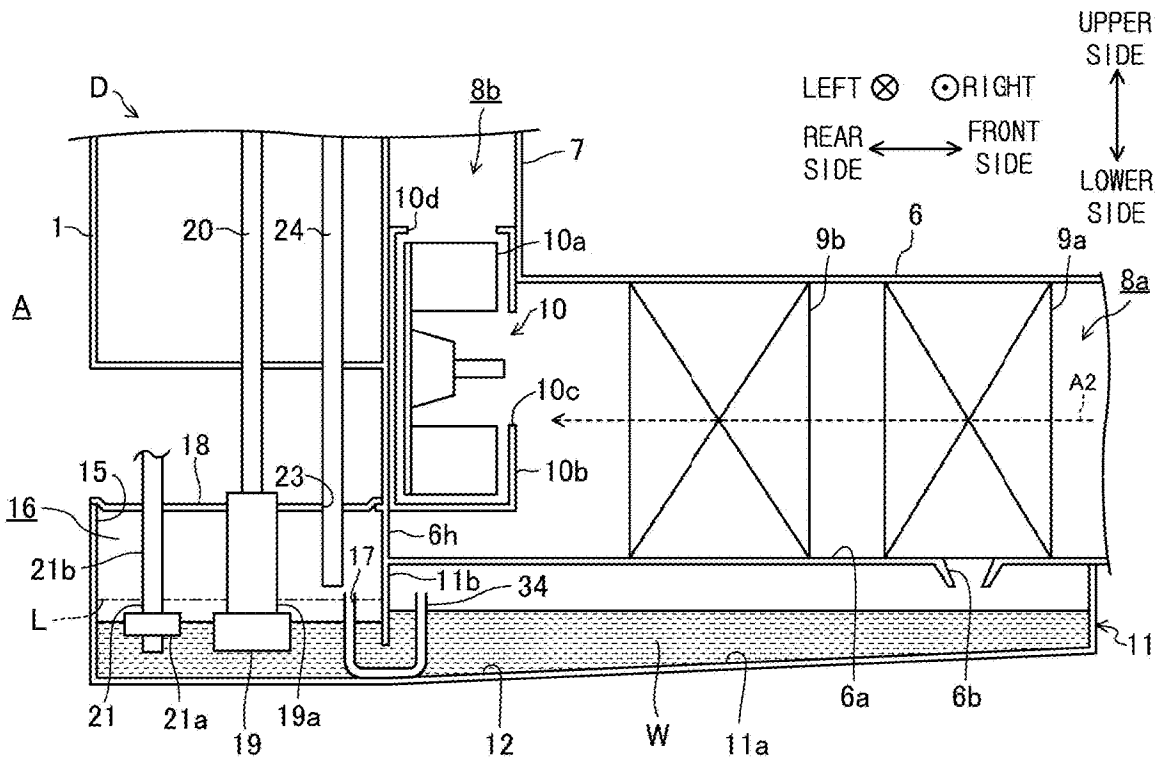

[Fig. 10a]
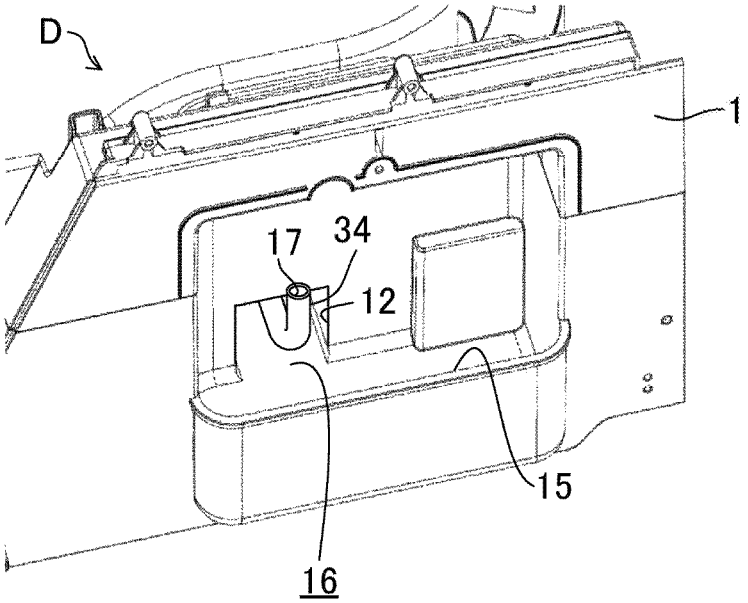
[Fig. 10b]
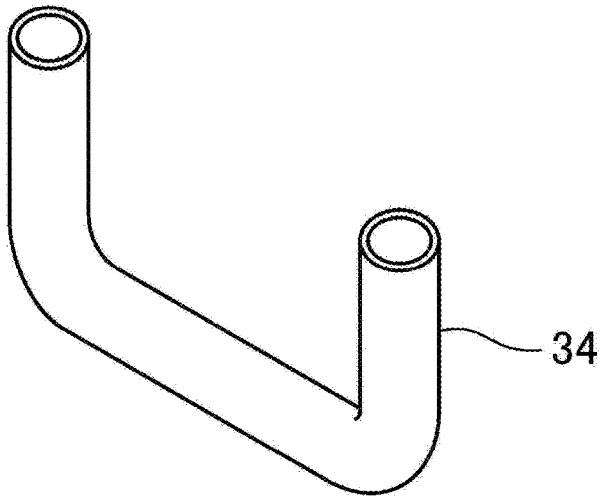

[Fig. 11]
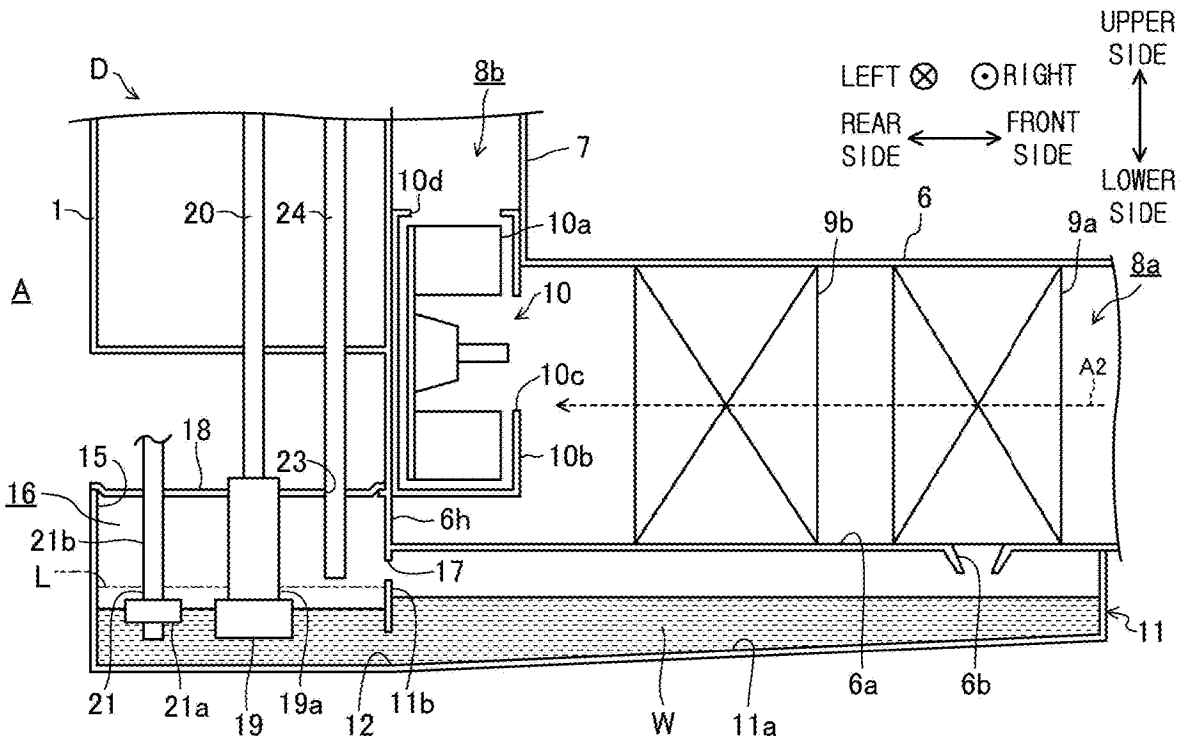

[Fig. 12]
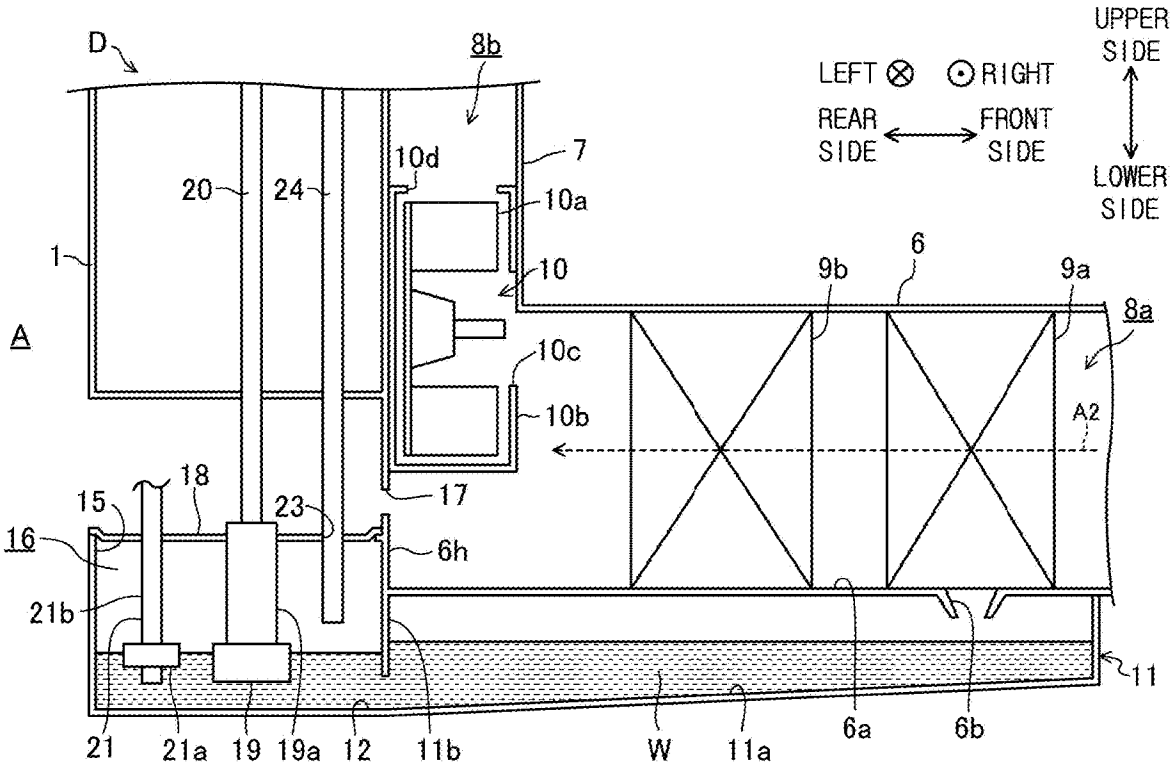

[Fig. 13a]
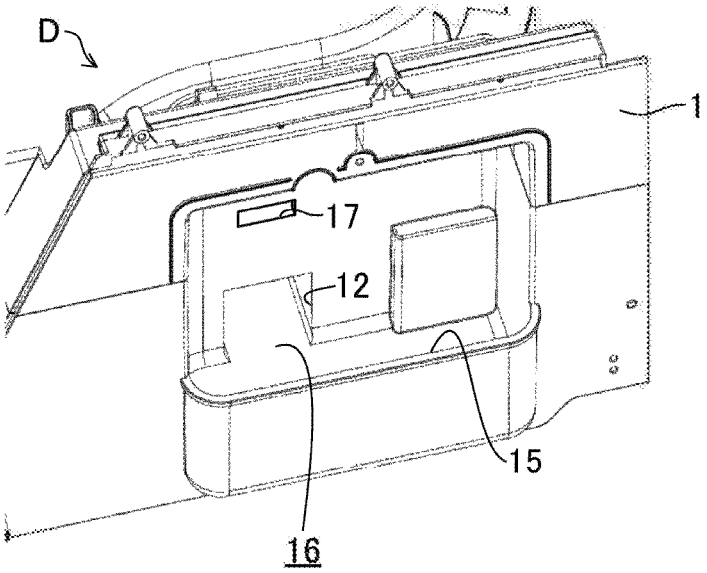
[Fig. 13b]
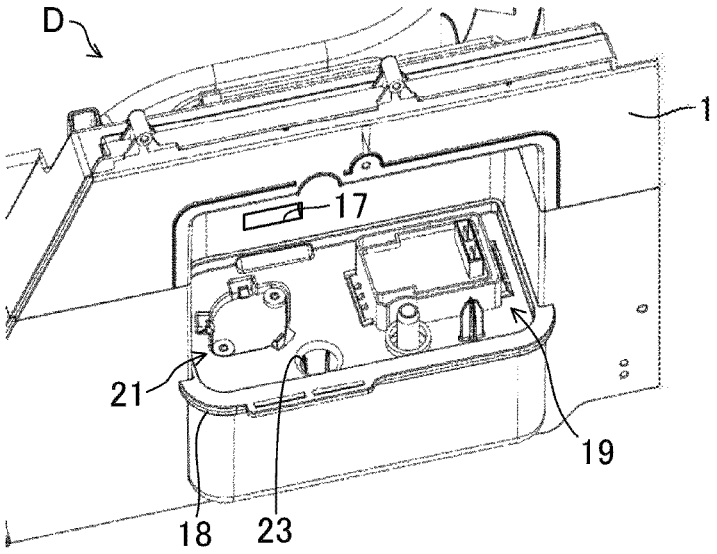

[Fig. 14]
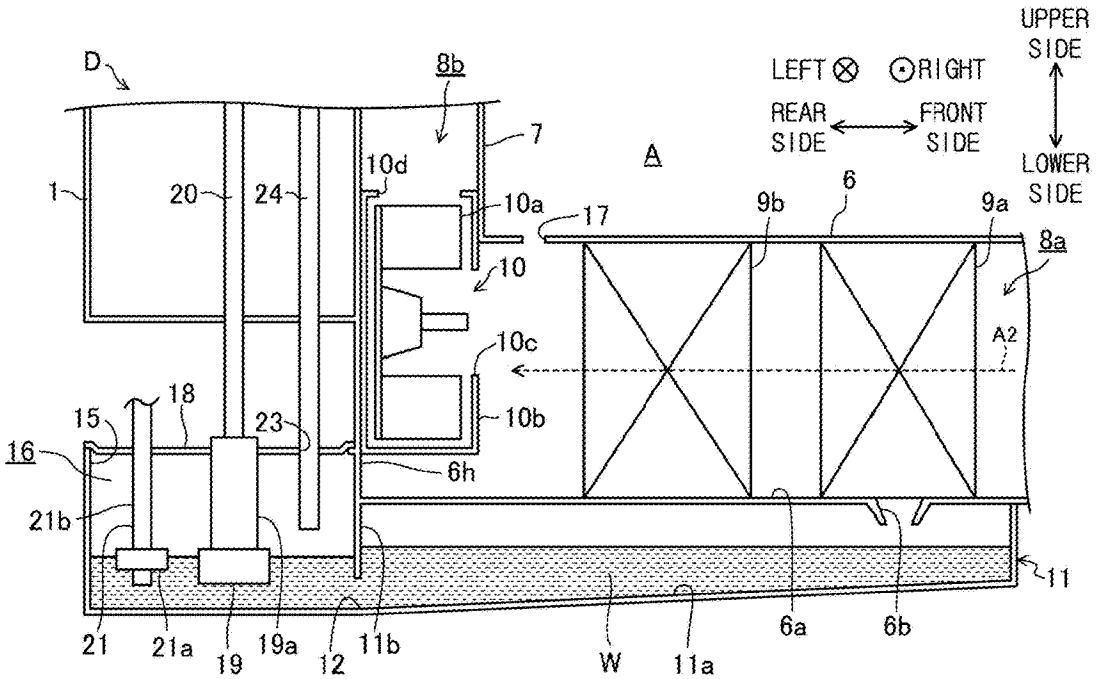
[Fig. 15]
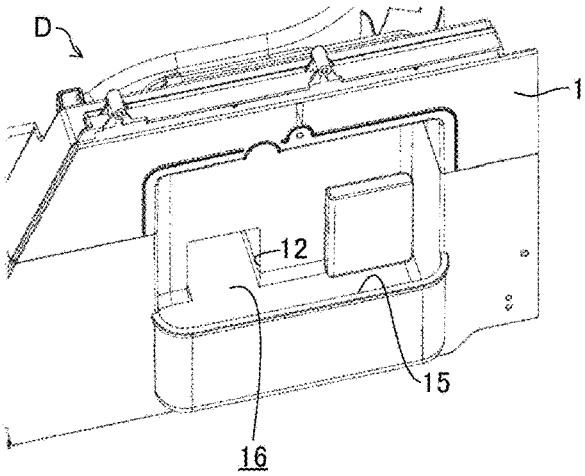

[Fig. 16]
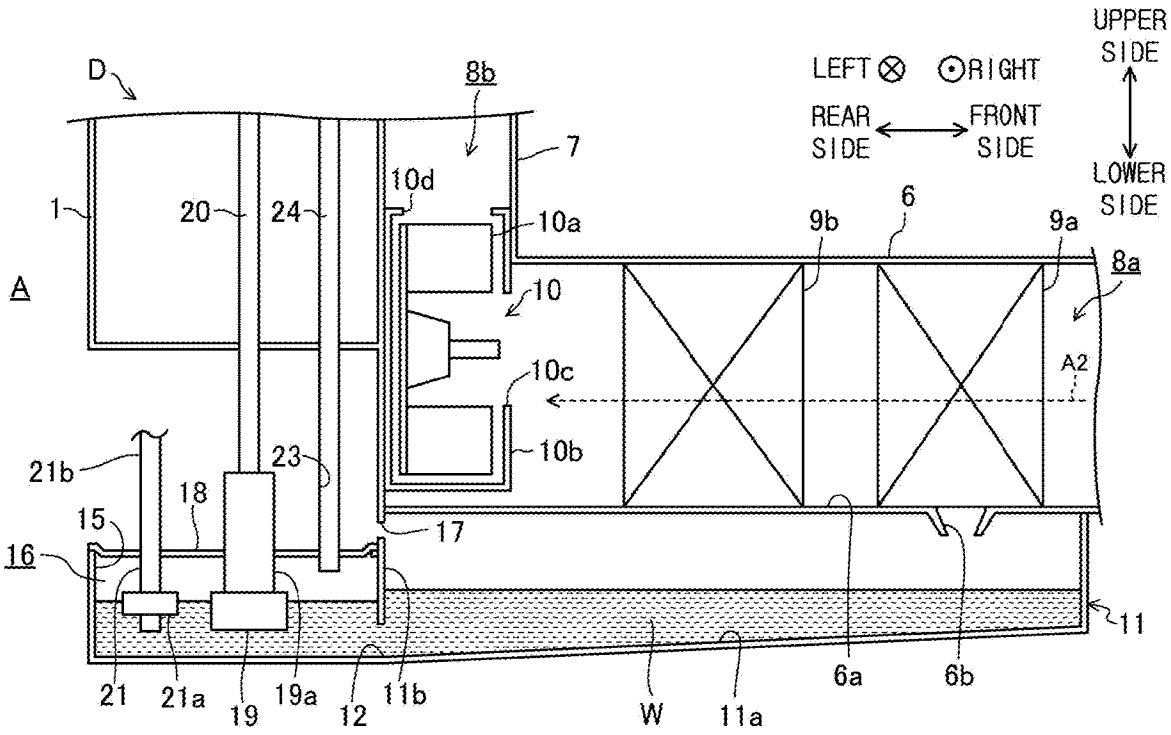

CLOTHES DRYER

CROSS-REFERENCE TO RELATED APPLICATION(S)

The present application claims priority under 35 U.S.C. § 365 to International Patent Application No. PCT/KR2015/005536 filed Jun. 2, 2015, which claims priority to Japanese Patent Application No. 2015-101667 filed May 19, 2015 and Korean Patent Application No. 10-2015-0078064 filed Jun. 2, 2015, the entire contents of each are incorporated herein by reference into the present disclosure as if fully set forth herein.

TECHNICAL FIELD

Embodiments disclosed herein relate to a clothes dryer capable of drying clothes.

BACKGROUND

Conventionally, a circulation-type clothes dryer circulating dehumidified and heated air has been widely used. In such a dryer, a fan device for circulating air for drying, a cooling device for cooling and dehumidifying the air for drying, and a heating device for heating the air passing through the cooling device were all disposed in the circulation air flow path.

In such a dryer, condensed water formed by dehumidification is attached to the surface of the cooling device in the form of droplets. As a result, a technique has been widely used wherein the technique is configured such that a condensed water container (drain pan) for collecting the condensed water is disposed and the condensed water recovered to the condensed water container is discharged to the outside or is stored in a separate water storage tank.

Patent document 1 discloses a technique of collecting condensed water dehumidified by a cooling device, in a drain pan and discharging the collected condensed water to the outside of a washing and drying machine by a pump. The drain pan is divided into a portion (hereinafter referred to as a condensed water storage chamber) communicated with an air flow path (hereinafter referred to as a first air flow path) in the side of the upstream of the fan device via a drain hole (opening), and a portion in which a pump is placed (hereinafter referred to as a pump chamber), wherein the condensed water storage chamber and the pump chamber are communicated with each other via a bottom portion thereof. Therefore, the condensed water collected in the condensed water storage chamber via the drain hole is stored in the pump chamber via the communicating portion (hereinafter referred to as a communication path)

In patent document 2, as another example of this technique, condensed water (dehumidified water) condensed in a cooling device (dehumidifying means) is recovered to a dehumidifying tank through a recovery flow path provided in the lower part of the cooling device, and the recovered condensed water is transferred to the water storage tank disposed above a body (a body of the clothes dryer) by a pump (water supply pump). Further, in the clothes dryer disclosed in patent document 2, when it is detected that the condensed water in the tank has reached a certain water level, by a water level sensor provided in the dehumidifying tank, the pump is driven to discharge the condensed water in the dehumidifying tank.

SUMMARY

It is conceivable that a wall portion configured to divide the pump chamber is provided with a removable covering portion for each pump section to improve the maintainability when using a pump chamber, as illustrated in patent document 1 (Japanese Patent Application Laid-Open No. 2011-239817).

However, the pump chamber configured as described above may not be constructed in a completely sealed structure, and thus a part of the pump chamber is exposed to the atmosphere. Accordingly, when the washing and drying machine using such a pump chamber starts to operate, the air pressure in both the pump chamber and the condensed water storage chamber becomes negative. However, the air pressure in the pump chamber is higher than the air pressure in the condensed water storage chamber since the pump chamber is communicated with the first air flow path through the condensed water storage chamber, and the atmosphere flows to the pump chamber, and thus the condensed water level stored in the pump chamber may become lower than the condensed water level stored in the condensed water storage chamber.

Particularly, as the amount of the condensed water stored in the pump chamber increases, the communication path connecting the condensed water storage chamber to the pump chamber is submerged and blocked. Accordingly, the atmosphere flows to the pump chamber but the airflow between the pump chamber and the first air flow path is obstructed, thereby further increasing the differential pressure and the water level difference.

It is conceivable to configure to lift the condensed water according to the water level sensor detection result provided in the pump chamber, such as a clothes dryer disclosed in patent document 2 (Japanese Patent Application Laid-Open No. 2014-33849). However, due to the increase in the water level difference as described above, the water level detection by the water level sensor is not performed normally and thus the pump may not operate normally. In this case, the condensed water storage chamber may become full or the condensed water may be stored near the full water volume before the pump is operated, and thus the condensed water may flow backward from the condensed water storage chamber into the circulation air flow path. The condensed water flowing backward may be pumped up with the air by the fan device and then scattered and sprayed on the clothes being dried or it may cause the malfunction in the drying operation.

It may be conceivable to additionally install a material, e.g., a packing, to a covering portion to reduce or to prevent the backflow, but in this case, a relatively high assembly degree is required, which increases the manufacturing cost. In addition, when the disassembled covering portion is assembled again since the assembly is defective when the time of manufacture or when parts are replaced, or for the maintenance, it is difficult to secure the desired airtightness, resulting in the inflow of air into the pump chamber, and further resulting in the backflow of the condensed water.

Even if a material having a sufficient airtightness is installed, the pump chamber is exposed to the atmosphere through the water storage tank or the hose when the pump chamber is communicated with the additional water storage tank via the hose. Accordingly, the atmosphere flows into the pump chamber.

That is, it may be difficult to completely prevent the backflow of the condensed water by a strategy of additionally installing the material, but it may cause the increase of the manufacturing cost.

As another strategy, the length of the communication path connecting the condensed water storage chamber and the pump chamber is widened in the height direction so that the communication path is not submerged even if the condensed water increases. In this case, even when the water level of condensed water is increased, the airflow between the pump chamber and the circulation air flow path is maintained, so that an increase in the differential pressure can be suppressed. However, the air flows from the pump chamber side to the condensed water storage chamber side through the widely secured communication path, thereby causing a wave on the received condensed water surface, which causes scattering of the condensed water.

In recent years, in order to improve the operating efficiency of the dryer, it is required to increase the air flow rate of the fan device. However, the air pressure at the upstream side of the fan device is further lowered due to the increase in the air flow rate, and thus the backflow of the condensed water easily occurs.

Such a problem is not limited to a configuration in which the pump chamber is closed by the removable covering portion or a configuration in which the pump chamber is communicated with the water storage tank, and is related to the entirety of a dryer having a pump chamber in which at least a part thereof is communicated with the atmosphere.

It is an aspect of the present disclosure to provide a clothes dryer capable of reliably preventing the backflow and the scattering of the condensed water generated by the dehumidification, and having a fan device having an increased air flow rate.

One aspect of the present disclosure provides a clothes dryer including a body, a drum provided inside of the body, a fan device configured to circulate air for drying supplied to the drum, a circulation air flow path communicated with the drum and in which the air for drying is circulated by the fan device, a cooling device configured to dehumidify the air for drying by cooling the air for drying in the circulation air flow path, a condensed water storage chamber communicated with the circulation air flow path and configured to store condensed water generated by the cooling device, a pump chamber communicated with an outside space of the circulation air flow path and configured to accommodate a pump pumping the condensed water, a first communication path configured to flow the condensed water stored in the condensed water storage chamber to the pump chamber by allowing the condensed water storage chamber to be communicated with the pump chamber and a second communication path configured to allow the circulation air flow path to be communicated with at least one of the pump chamber and the outside space of the circulation air flow path.

The circulation air flow path comprises a first air flow path communicated with the condensed water storage chamber to allow the air for drying passed through the drum to flow to the fan device, and a second air flow path provided to allow the air for drying passed through the fan device to flow to the drum, again.

The second communication path maintains at least one communication among the first air flow path, the pump chamber and the outside space of the circulation air flow path, when the first air flow path is closed by the condensed water since the condensed water stored in the pump chamber is increased.

An opening of the second communication path is provided in a position higher than a position in which the first communication path is provided.

One end of the second communication path is opened in the pump chamber and other end of the second communication path is opened in the first air flow path.

A drain portion configured to allow the condensed water storage chamber to be communicated with the first air flow path, and the second communication path is closer to the fan device than the drain portion.

One end of the second communication path is opened in the pump chamber and other end of the second communication path is opened in the condensed water storage chamber so that the pump chamber is communicated with the first air flow path through the condensed water storage chamber.

The second communication path is provided in a position higher than a position in which the first communication path is opened in the condensed water storage chamber.

A portion of the second communication path penetrates the first communication path.

The second communication path is formed in a tubular shape, and the second communication path comprises a curved portion so that the curved portion penetrates the first communication path.

A partition member is provided in the first communication path to partition the first communication path, and thus the second communication path is provided between the first communication path by the partition member.

One end of the second communication path is opened in the first air flow path and other end of the second communication path is opened in a rear side of the body.

The second communication path is closer to the fan device than the drain portion configured to allow the condensed water storage chamber to be communicated with the first air flow path.

One end of the second communication path is opened in the condensed water storage chamber and the other end of the second communication path is opened to the outside space of the body so that the first air flow path is communicated with the outside space of the body through the condensed water storage chamber.

The pump chamber comprises an opening opened to the atmosphere, and a covering portion removably provided to close the opening of the pump chamber.

A water storage tank storing condensed water pumped from the pump chamber; a connecting waterway connecting the pump and the water storage tank, and the pump chamber is communicated with the outside space of the circulation air flow path through the connecting waterway.

One aspect of the present disclosure provides a clothes dryer including a drum, a circulation air flow path communicated with the drum and configured to allow air for drying to be circulated, the circulation air flow path provided with a first air flow path configured to allow the air for drying passed through the drum to be cooled and dehumidified, and a second air flow path configured to allow the dehumidified air for drying to flow to the drum, again, a condensed water storage chamber communicated with the first air flow path and configured to store condensed water generated by a cooling device, a pump chamber provided with an inlet port configured to allow condensed water stored in the condensed water storage chamber to be introduced and a pump configured to pump condensed water, the pump chamber communicated with the outside space of the circulation air flow path, and at least one communication path configured to introduce air to at least one of the first air flow path and the pump chamber to reduce the pressure difference between the condensed water storage chamber and the pump chamber.

In order to reduce the pressure in the pump chamber by flowing the air to the pump chamber, one end of the at least one communication path is opened in the pump chamber and other end of the at least one communication path is opened in at least one of the inside of the first air flow path and the condensed water storage chamber.

In order to increase the pressure in the condensed water storage chamber by flowing the air to the condensed water storage chamber, one end of the at least one communication path is opened in the first air flow path and other end of the at least one communication path is communicated with at least one of the inside of the pump chamber and the outside of the circulation air flow path.

One end of the at least one communication path is opened in the condensed water storage chamber to be communicated with the first air flow path and the other end of the at least one communication path is communicated with the outside of the circulation air flow path.

According to the proposed clothes dryer, it is possible to reliably prevent the backflow and the scattering of the condensed water, which is generated by the dehumidification, and it is possible to allow a fan device to have an increased air flow rate.

BRIEF DESCRIPTION OF THE DRAWINGS

FIG. 1 is longitudinal section views illustrating a clothes dryer with omitting some structure according to a first embodiment of the present disclosure;

FIG. 2 is enlarged longitudinal section views illustrating a condensed water storage chamber and a pump chamber for the clothes dryer according to a first embodiment of the present disclosure;

FIG. 3 is schematic views illustrating a the main part of the heat pump cycle for the clothes dryer according to a first embodiment of the present disclosure;

FIG. 4*a* is an enlarged perspective view showing a part of the structure of the pump chamber according to the first embodiment;

FIG. 4*b* is an enlarged perspective view showing a state in which a lid is attached to the pump chamber according to the first embodiment;

FIG. 5 is a view corresponding to FIG. 1 showing a modification of the clothes dryer according to the first embodiment, partially omitted;

FIG. 6 is an enlarged perspective view showing a part of the bottom structure of the clothes dryer according to the first embodiment;

FIG. 7 is a view corresponding to FIG. 2 showing a part of the structure of the pump chamber and the condensed water storage chamber according to the second embodiment;

FIG. 8*a* is a view corresponding to FIG. 4*a* showing a part of the pump chamber structure according to the second embodiment;

FIG. 8*b* is a perspective view schematically showing the structure of the partition member according to the second embodiment;

FIG. 9 is a view corresponding to FIG. 2 showing a part of the structure of the condensed water storage chamber and the pump chamber according to the first modified example of the second embodiment;

FIG. 10*a* is a view corresponding to FIG. 4*a* showing a part of the structure of the pump chamber according to the first modification of the second embodiment;

FIG. 10*b* is a view showing the structure of the tube according to the modification of FIG. 10*a;*

FIG. 11 is a view corresponding to FIG. 2 showing a part of the structure of the condensed water storage chamber and the pump chamber according to the second modification of the second embodiment;

FIG. 12 is a view corresponding to FIG. 2 showing a part of the structure of the condensed water storage chamber and the pump chamber according to the third embodiment;

FIGS. 13*a* and 13*b* show a part of the structure of the pump chamber according to the third embodiment;

FIG. 14 is a view corresponding to FIG. 2 showing a modification of the third embodiment;

FIG. 15 is a view corresponding to FIG. 4*a* showing a part of the structure of the pump chamber according to the modification of the third embodiment; and FIG. 16 is a view corresponding to FIG. 2 showing a part of the structure of the condensed water storage chamber and the pump chamber according to the fourth embodiment.

DETAILED DESCRIPTION

Hereinafter, embodiments of a dryer will be described with reference to the drawings. The following description of the embodiments is merely exemplary in nature.

First Embodiment

First, a first embodiment will be described.

<Overall Configuration of a Clothes Dryer>

As illustrated in FIG. 1, a clothes dryer D as a dryer is provided with a body 1 having a vertically elongated rectangular parallelepiped shape extending along the vertical direction. A clothes inlet 2 is opened in the upper part of the front surface of the body 1, wherein the clothes inlet 2 is formed in a circular shape when viewing from the front side, and is opened or closed by a pivotable covering portion 3. A drum 4 corresponding to an object accommodating portion is communicated with the clothes inlet 2 to accommodate clothes C that is an object of drying, and the drum 4 is rotatably supported in the upper portion of the inside of the body 1. When the covering portion 3 is opened, the drum 4 may accommodate the clothes C put through the clothes inlet 2.

The drum 4 is formed in cylindrical shape having a bottom having a rotary shaft center in the horizontal front and back direction. In a state in which an opening of the drum 4 is toward the clothes inlet 2, the center of the bottom portion of the drum 4 may be supported against a side wall portion of an intake side duct 7 to be rotatable via a shaft 30, and the drum 4 may be rotated with respect to the rotary shaft center. A circulation discharge port 31 discharging air used for drying the clothes C, and a circulation intake port 32 sucking the air used for drying the clothes C are communicated with the drum 4.

The shaft 30 is connected to a drum rotation motor (not shown) disposed in the body 1 and is driven by the drum rotation motor when the clothes dryer D is operated to rotate the drum 4 at a predetermined speed. It is possible to directly rotate the drum 4 via a belt (not shown) by the rotation motor.

In the body 1, a discharge side duct 5 whose one end is communicated with the circulation discharge port 31 and the intake side duct 7 whose one end is communicated with the circulation intake port 32, and a heat drying duct 6 connecting the other end of the discharge side duct 5 to the other end of the intake side duct 7 are installed. An endless circulation air flow path 8 circulating the air for drying by passing through the drum 4 is formed by a space in the ducts 5, 6, and 7. A lint filter 29 may be installed between the ducts 5 and 6 to collect lint generated from the clothes C, and as needed, the lint may be discharged to the outside of the body 1.

Particularly, the discharge side duct 5 is extended in the vertical direction on the front side in the body 1. The upper end portion of the discharge side duct 5 is connected to the circulation discharge port 31 in a sealed manner. The heat drying duct 6 is extended in the front and back direction on the bottom side (the lower side of the drum 4) in the body 1 and an end portion of the front side is connected to the lower end portion of the discharge side duct 5 in a sealed manner. The intake side duct 7 is extended in the vertical direction on the rear side in the body 1 and the lower end portion of the intake side duct 7 is connected to the rear end portion of the heat drying duct 6 in a sealed manner. In addition, the end portion of the intake side duct 7 is connected to the circulation intake port 32 in a sealed manner. The drum 4 is connected to the circulation discharge port 31 and the circulation intake port 32 in a sealed manner or a freely rotatable manner.

As illustrated in FIG. 2, a fan device 10 is installed in a connecting portion between the heat drying duct 6 and the intake side duct 7, which is the circulation air flow path 8 extending in the front and back direction in the lower portion of the clothes dryer D is curved toward the upper portion. Particularly, as illustrated in FIG. 2, the fan device 10 is provided with a casing 10*b* and a cylindrical impeller 10*a* rotatably supported in the casing 10*b* to have a plurality of blades on a side surface thereof. The casing 10*b* is provided with an intake port 10*c* that opens in a direction parallel to the rotation axis of the impeller 10*a* and a discharge port 10*d* that opens in a direction perpendicular to the rotation axis. The intake port 10*c* and the discharge port 10*d* are connected to the rear end of the heat drying duct 6 and the lower end of the intake side duct 7, respectively. In addition, for example, a centrifugal fan device having a multi-blade fan (sirocco fan) may be applied to the fan device 10.

As illustrated in FIGS. 1, 2, 3 and 6, the circulation air flow path 8 is provided with an evaporator 9*a* composed of a heat exchanger as a cooling device for cooling and dehumidifying air, a condenser 9*b* as a heater heating the air passed through the cooling device. The evaporator 9*a* and the condenser 9*b* are installed and supported on a cover base 6*a* corresponding to a supporting plate, in the heat drying duct 6. The evaporator 9*a* is installed in the upstream side (front side) of the circulation air flow path 8 and the condenser 9*b* is installed in the downstream (rear side) of the evaporator 9*a* to be apart from the evaporator 9*a* by a predetermined distance.

The circulation air flow path 8 is provided with a first air flow path 8*a* in which the air for drying passing through the drum 4 flows to the fan device 10 by passing through the evaporator 9*a* and the condenser 9*b* in order, and a second air flow path 8*b* separated from the first air flow path 8*a*, and in which the air for drying passing through the fan device 10 flows to the drum 4. According to the first embodiment, the first air flow path 8*a* is formed by the discharge side duct 5 and the heat drying duct 6 and the second air flow path 8*b* is formed by the intake side duct 7. By the operation of the fan device 10, the first air flow path 8*a* becomes the negative pressure while the second air flow path 8*b* becomes the positive pressure. The size of the negative pressure and the positive pressure, that is the magnitude of the differential pressure between the atmospheric pressure and the air pressure in the first air flow path 8*a* or the second air flow path 8*b*, increases from the drum 4 toward the fan device 10, respectively.

As illustrated in FIG. 3, in the clothes dryer D, a compressor 9*c* and a decompressor 9*d* are provided in the body 1, the evaporator 9*a*, the compressor 9*c*, and the condenser 9*b*, and the decompressor 9*d* are connected in order via a refrigeration pipe 9*e* so that a heat pump cycle 9 is formed. According to the above mentioned configuration, the evaporator 9*a* and the condenser 9*b* exchange heat between the air flowing into the heat drying duct 6.

As illustrated in FIG. 3, when the heat pump cycle 9 is operated, gas refrigerant, which is discharged from the compressor 9*c* and at a high temperature and a high pressure, becomes liquid refrigerant at a low temperature and a low pressure after being condensed in the condenser 9*b* and expanded in the decompressor 9*d*. The liquid refrigerant is evaporated in the evaporator 9*a* and then returns to the compressor 9*c*. As a result, the air is cooled and dehumidified by the evaporation heat generated when the refrigerant passes through the evaporator 9*a*, while the air is heated by the condensation heat generated when the refrigerant passes through the condenser 9*b*.

As illustrated in FIGS. 1, 2, and 6, a condensed water storage chamber 11 collecting and storing the condensed water W generated in the evaporator 9*a* is provided below the heat drying duct 6. The condensed water storage chamber 11 is opened upward and an opening thereof is closed by the cover base 6*a*. The heat drying duct 6 and the condensed water storage chamber 11 is partitioned by the cover base 6*a*.

A drain hole 6*b* is formed in the cover base 6*a* as a drain portion corresponding to a communication path penetrating in the vertical direction directly below the evaporator 9*a*. The condensed water W, which is generated when the air for drying in the first air flow path 8*a* is dehumidified by the evaporator 9*a*, is discharged to the condensed water storage chamber 11 through the drain hole 6*b*. The cover base 6*a* is inclined toward the lower side as it approaches the drain hole 6*b* from the lower side of the evaporator 9*a* (see FIGS. 2 and 6), and the cover base 6*a* guides the condensed water W dropped around the drain hole 6*b* to the drain hole 6*b*.

The condensed water storage chamber 11 is communicated with the first air flow path 8*a* by the drain hole 6*b* and collects the condensed water W through the drain hole 6*b*. As illustrated in FIGS. 2 and 6, a bottom surface 11*a* of the condensed water storage chamber 11 is inclined downward from the front side toward the rear side, so that the collected condensed water W flows backward. The width of the condensed water storage chamber 11 in the left-right direction is narrowed as being near the rear side, as shown in FIG. 6, so that the condensed water W more stably flows as being near the rear side.

According to the embodiment, the clothes dryer (D) includes a pump chamber 16 containing a pump 19 pumping the condensed water W collected in the condensed water storage chamber 11. The pump chamber 16 is mounted on the rear lower portion of the body 1 and communicated with the condensed water storage chamber 11 through a first communication path 12 (i.e., an inlet, hereinafter referred to as a first communication path).

Particularly, as illustrated in FIGS. 2 and 6, on a wall portion 11*b* in the rear side of the condensed water storage chamber 11 (hereinafter referred to as a rear wall portion), the first communication path 12 penetrating the lower portion of the rear wall portion 11*b* is formed and a rear end portion of the condensed water storage chamber 11 and a front end portion of the pump chamber 16 is integrally connected to each other by the first communication path 12. The first communication path 12 is formed as a through-hole extending substantially in the front and back direction and the first communication path 12 is configured to allow the condensed water storage chamber 11 to be communicated with the pump chamber 16 through the bottom portions thereof. The condensed water W flowing from the condensed water storage chamber 11 is guided to the pump chamber 16 by the first communication path 12. As shown in FIGS. 2 and 6, the height at which the first communication path 12 is opened in the condensed water storage chamber 11 is lower than the lower end of the drain hole 6*b*.

The pump chamber 16 is opened toward the upper side and defines a space in the form of a horizontally long rectangular parallelepiped which is communicated with the space outside of the body 1 through the opening 15 as shown in FIGS. 4A and 6. The pump chamber 16 is equipped with a removable covering portion 18 configured to close the opening 15 in a substantially sealed manner. The covering portion 18 is formed to be fittable around the opening 15 of the pump chamber 16 and the covering portion 18 is mounted to the opening 15 by being coupled to the opening 15. In the around of the rear surface of the covering portion 18, a material (not shown) formed of a soft material having a viability such as natural rubber and soft resin is mounted and thus when the covering portion 18 is fitted into the opening 15, the opening 15 is closed in a substantially sealed manner.

As illustrated in FIG. 4B, the pump 19 pumping the condensed water W accommodated in the pump chamber 16 is mounted on the right portion of the covering portion 18, and a water level sensor 21 corresponding to a water level detector detecting the water level of the water in the pump chamber 16 is mounted on the left portion of the covering portion 18. In addition, a hose connecting hole 23 is formed at a substantially central portion on the front portion of the covering portion 18 in the left-right direction. As illustrated in FIGS. 1 and 2, a leak-proof hose 24 is inserted in the hose connecting hole 23 in the liquid-tight state (not shown in FIGS. 4B and 6). The pump 19, the water level sensor 21 and the leak-proof hose 24 may be individually detachable from the covering portion 18, respectively.

The pump 19 is a water lift type submersible pump and has a pump casing 19*a* provided with an absorption port and a discharge port (both not shown). The pump 19 is fixed to the covering portion 18 such that the absorption port is located near the bottom of the pump chamber 16 while the discharge port is located above the covering portion 18. The condensed water W stored in the pump chamber 16 is pumped by the operation of the pump 19.

One end of a water lift hose 20 (e.g, a synthetic resin product) corresponding to a connecting waterway is connected to the discharge port of the pump 19. As illustrated in FIG. 1, the other end of the water lift hose 20 is connected to the additional water storage tank 25 and then delivers the condensed water W pumped from the pump chamber 16 to the water storage tank 25. The water storage tank 25 is disposed above the drum 4 in the body 1 and thus as needed, the water storage tank 25 may be pulled out from the body 1.

The water storage tank 25 is installed in a condensed water storage chamber for a storage water tank 26 formed in the accommodation container shape, and the condensed water W overflowing from the water storage tank 25 is stored in the condensed water storage chamber for the water storage tank 26. The leak-proof hose 24 is connected to the bottom of the condensed water storage chamber for the water storage tank 26, as illustrated in FIGS. 1 and 2, and the condensed water W overflowing from the water storage tank 25 is returned to the pump chamber 16 via the leak-proof hose 24. In the clothes dryer D according to the embodiment, the pump chamber 16 and a space A except for the circulation air flow path are communicated with each other through the condensed water storage chamber for the water storage tank 26 and the leak-proof hose 24. In addition, for the convenience of description, FIG. 1 illustrates the water lift hose 20 and the leak-proof hose 24 are disposed in the rear side of the intake side duct 7, but the water lift hose 20 and the leak-proof hose 24 may be disposed in the left side or the right side of the intake side duct 7.

The water level sensor 21 has a tubular stem 21*b* hanged on the pump chamber 16 from the covering portion 18 and a float 21*a* supported by the stem 21*b* to be vertically movable within a predetermined range with respect to the stem 21*b*. The water level sensor 21 senses the water level by the height of the float 21*a*. According to the embodiment, the clothes dryer D includes a controller (not shown). The controller operates the pump 19 when the water level sensed by the water level sensor 21 exceeds a predetermined threshold level L.

As illustrated in FIGS. 2, 4A and 6, a second communication path 17 is installed in the lower end portion of the rear wall portion 6*h* of the heat drying duct 6 to which the rear end of the cover base 6*a* is connected, wherein the second communication path 17 is a through hole type elongating in the left and right direction and extending in the front and back direction. The rear end of the second communication path 17 is opened in the pump chamber 16 while the front end of the second communication path 17 is opened in the first air flow path 8*a*. The second communication path 17 allows the first air flow path 8*a* to be communicated with the pump chamber 16 to reduce the differential pressure between the condensed water storage chamber 11 and the pump chamber 16.

The second communication path 17 (i.e., a communication path, hereinafter referred to as a second communication path) is opened in the pump chamber 16 in a position higher than a position in which the first communication path 12 is opened in the pump chamber 16, as illustrated in FIGS. 2 and 6. In addition, the second communication path 17 is configured such that a height in which the second communication path 17 is opened in the pump chamber 16 and a height in which the second communication path 17 is opened in the condensed water storage chamber 11 are higher than the threshold level L in which the pump 19 starts to operate.

As illustrated in FIGS. 2 and 6, the second communication path 17 is opened into the first air flow path 8*a* in the direct downstream than the drain hole 6*b*.

<Operation of Clothes Dryer>

Next, the operation of the clothes dryer D according to the present embodiment will be described.

First, when the clothes dryer D starts to operate, the drum rotation motor, the fan device 10 and the heat pump cycle 9 operate. A pressure difference occurs such that in the circulation air flow path 8, the first air flow path 8*a* becomes the negative pressure and the second air path 8*b* becomes the positive pressure by the operation of the fan device 10. For example, the air pressure on the direct upstream side of the fan device 10 may be lower than the atmospheric pressure by 300 Pa or more. The air in the drum 4 circulates in the circulation air flow path 8 as the air for drying in accordance with the differential pressure.

Particularly, as illustrated by arrows A1 and A2 in FIG. 1, the air for drying in the drum 4 flows into the discharge side duct 5 through the circulation discharge port 31, and then flows toward the lower portion in the front side of the body 1 and then flows into the heat drying duct 6.

As illustrated by the arrow A2 in FIG. 1, the air introduced into the heat drying duct 6 flows the lower side of the body 1 toward the rear side along the heat drying duct 6. In the heat drying duct 6, the evaporator 9*a* and the condenser 9*b* constituting the heat pump cycle 9 are disposed in order in the downstream of the heat drying duct 6. Therefore, as the air for drying passes through the heat drying duct 6, the air for drying is cooled and dehumidified in the evaporator 9*a*, and then heated in the condenser 9*b* so as to be adjusted to a state suitable for drying the clothes C.

Since the intake port 10*c* and the discharge port 10*d* of the fan device 10 face the heat drying duct 6 and the intake side duct 7, the air for drying that is passed through the heat drying duct 6 is passed through inside of the fan device 10 and delivered, and introduced into the intake side duct 7 as illustrated by the arrows A2 and A3 of FIG. 1. As illustrated by the arrow A3 of FIG. 1, the air for drying flowing into the intake side duct 7 flows to the upper portion in the rear side of the body 1 along the intake side duct 7 and then flows into the drum 4 through the circulation intake port 32.

By repeating the circulation process as described above, the air for drying is maintained at a predetermined humidity and temperature while the clothes dryer D operates, thereby drying the clothes C in the drum 4. Since the drum 4 is rotated at a predetermined speed by driving the drum rotation motor (not shown) during the operation of the clothes dryer D, the clothes C in the drum 4 are agitated, so that the air for drying is uniformly supplied to the clothes C in the drum 4.

When the circulation process is repeated, the condensed water W in the form of water droplets, which is generated by the dehumidification, is attached to the surface of the evaporator 9*a*. The attached condensed water W is dropped and led to the drain hole 6*b* in accordance with the inclination of the cover base 6*a* and flows from the drain hole 6*b* to the condensed water storage chamber 11. The condensed water W flowing into the condensed water storage chamber 11 flows to the rear side along the bottom surface 11*a* of the condensed water storage chamber 11 and is supplied to and stored in the pump chamber 16 through the first communication path 12.

When the circulation process is further repeated, the water level of the condensed water stored in the pump chamber 16, the first communication path 12, and the condensed water storage chamber 11 rises. When the water level sensor 21 detects that the water level in the pump chamber 16 has reached the water level equal to or higher than the predetermined threshold level L, the controller operates the pump 19. The condensed water W accommodated in the pump chamber 16 and the condensed water storage chamber 11 is pumped by the operated pump 19 and transferred to the water storage tank 25 through the water lift hose 20.

Since the first air flow path 8*a* is communicated with the condensed water storage chamber 11 through the drain hole 6*b*, the pressure in the condensed water storage chamber 11 is adjusted to be close to the negative pressure in the first air flow path 8*a*. Meanwhile, the condensed water storage chamber 11 is communicated with the pump chamber 16 through the first communication path 12. When the first air flow path 8*a*, the condensed water storage chamber 11, the pump chamber 16 are communicated with each other by using only the drain hole 6*b* and the first communication path 12 as described in patent document 1, the pressure in the pump chamber 16 becomes larger than the pressure in the condensed water storage chamber 11 (i.e., it is close to the atmospheric pressure) since the pump chamber 16 is communicated with the first air flow path 8*a* through the condensed water storage chamber 11, and due to the atmosphere flowing into the pump chamber 16 from the space A except for the circulation air flow path (hereinafter referred to as outside A). However, according to the first embodiment, since the pump chamber 16 is provided with the second communication path 17, the air pressure in the pump chamber 16 is adjusted to be close to the negative pressure in the first air flow path 8*a* by the flow of air through the first communication path 12 and further the flow of air through the second communication path 17. Accordingly, the differential pressure between the pump chamber 16 and the condensed water storage chamber 11 is reduced.

As the amount of the condensed water W accommodated in the pump chamber 16 and the condensed water storage chamber 11 increases, the first communication path 12 is closed by the condensed water W, but the second communication path 17 maintains the communication between the pump chamber 16 and the first air flow path 8*a* even when the first communication path 12 is closed (submerged), as illustrated in FIGS. 1 and 2. Therefore, when the first communication path 12 is submerged, the flow of air through the first communication path 12 is prevented but the flow of air through the second communication path 17 is maintained. Accordingly, although the first communication path 12 is submerged, the differential pressure between the pump chamber 16 and the condensed water storage chamber 11 is reduced. It is possible to prevent the difference in the water level of the condensed water W of the condensed water storage chamber 11 and the pump chamber 16 so as to prevent the increase of the differential pressure between the pump chamber 16 and the condensed water storage chamber 11 and to allow the water level in the pump chamber 16 to be relatively high while allowing the water level in the condensed water storage chamber 11 to be relatively low. As a result, the pump 19 can be operated normally, and the backflow and the scatter of the condensed water W may be more reliably prevented.

As described above, according to the first embodiment, the clothes dryer D is capable of more reliably preventing the backflow and the scatter of the condensed water W although the fan device 10 having a high air flow rate is provided. That is, it is allowed that the air flow rate of the fan device 10 provided in the clothes dryer D is increased.

Since the pump chamber 16 and the first air flow path 8*a* are directly communicated with each other, when the air is introduced into the pump chamber 16, at least a part of the air flows into the first air flow path 8*a* through the second communication path 17 to be sucked into the first air flow path 8*a*. Since the air flowing into the first air flow path 8*a* increases the pressure in the first air flow path 8*a* and then the pressure in the condensed water storage chamber 11 in order, when the pressure in the pump chamber 16 is increased by the introduction of the air, it is possible to also increase the pressure in the condensed water storage chamber 11. Therefore, it is possible to prevent the differential pressure between the pump chamber 16 and the condensed water storage chamber 11.

When the atmosphere is introduced into the pump chamber 16, the atmosphere is introduced into the first air flow path 8*a* through the second communication path 17 or the increase of the differential pressure is prevented. Therefore, it is possible to prevent the atmosphere introduced into the pump chamber 16 from scattering of the condensed water W caused by a wave on the surface of the condensed W in the condensed water storage chamber 11.

Further, the condensed water W, which is overflowed from the water storage tank 25 due to unforeseen events, falls and flows over the condensed water storage chamber for the water storage tank 26 installed in the lower side of the water storage tank 25, and then returns to the pump chamber 16 through the leak-proof hose 24.

Since it is possible for the pressure in the pump chamber 16 to be close to the negative pressure in the first air flow path 8*a* since the first air flow path 8*a* is communicated with the pump chamber 16, it is possible to prevent the increase of the pressure in the first air flow path 8*a* and further in the second air flow path 8*b*. Accordingly, it is possible to prevent the leakage of the air for drying in the each duct 5, 6 and 7 and to prevent the generation of the condensation caused by the leakage.

Since the height in which the second communication path 17 is opened in the pump chamber 16 is higher than the height in which the first communication path 12 is opened in the pump chamber 16, it is prevented that the condensed water (W) in the pump chamber 16 is reverse-flowed via the second communication path 17 or the condensed water W in the pump chamber 16 submerges the second communication path 17, so that the communication by the second communication path 17 is maintained.

The second communication path 17 is configured such that the position in which the second communication path 17 is opened in the first air flow path 8*a* is closer to the direction upstream of the fan device 10 than the drain hole 6*b*. Particularly, as illustrated in FIGS. 1 and 2, while the drain hole 6*b* is installed on the cover base 6*a*, the second communication path 17 is formed on the rear wall portion 6*h* which is closer to the fan device 10 than the drain hole 6*b*. Therefore, since the second communication path 17 is closer to the fan device 10 than the drain hole 6*b*, the ambient atmospheric pressure of the second communication path 17 is lower than the ambient atmospheric pressure of the drain hole 6*b*. Accordingly, it is possible to maintain the pump chamber 16 at the low pressure and further it is possible to maintain the high water level of the pump chamber 16.

Both of the height in which the second communication path 17 is opened in the pump chamber 16 and the height in which the second communication path 17 is opened in the condensed water storage chamber 11 are higher than the water level threshold value in which the pump 19 starts to operate and thus it is prevented that the condensed water (W) in the pump chamber 16 is reverse-flowed via the second communication path 17 or the condensed water W in the pump chamber 16 submerges the second communication path 17, so that the communication by the second communication path 17 is maintained.

Further, since the opening 15 of the pump chamber 16 is closed by the cover portion 18 in the substantially sealed manner, the air is prevented from flowing into the pump chamber 16. Therefore, it is possible to prevent the increase of the pressure in the pump chamber 16 and further to maintain the high water level in the pump chamber 16.

The evaporator 9*a* and the condenser 9*b* forming the heat pump cycle 9 are used as a cooling device and a heating device. In this case, since the heat exchange efficiency between the air for drying, and the evaporator 9*a* and the condenser 9*b* is improved as the air flow rate of the air flowing in the circulation air flow path 8 is increased, it is possible to obtain the effect of the installation of the fan device 10 having the high air flow rate.

Since the condensed water storage chamber 11 and the heat drying duct 6 are separated by the cover base 6*a* supporting the evaporator 9*a* and the condenser 9*b*, it is possible to prevent the flow of the air for drying, wherein the air for drying is introduced from the condensed water storage chamber 11 in the front side of the evaporator 9*a* and then introduced into the fan device 10 through the condensed water storage chamber 11.

Modification of the First Embodiment

According to the first embodiment, the height in which the second communication path 17 is opened in the pump chamber 16 is higher the height in which the first communication path 12 is opened in the pump chamber 16, but is not limited thereto. For example, a space configured to push the condensed water W flowing into the pump chamber 16 is provided by using a wall portion standing in the pump chamber 16, and the space is communicated with the first air flow path 8*a* so that the second communication path 17 is formed. According to the above mentioned configuration, the second communication path 17 may be opened in the pump chamber 16 in a position lower than a position in which the first communication path 12 is opened in the pump chamber 16.

According to the configuration, it may be possible to adjust the threshold level L in which the pump 19 starts to operate.

Second Embodiment

Hereinafter according to the second embodiment, a clothes dryer D will be described. The following description explains the difference in the operation of between the first and second embodiments, and the effect obtained by the difference.

As illustrated in FIG. 7, according to the second embodiment, the first communication path 12 is recessed downward in the height direction than the first communication path 12 according to the first embodiment, and a partition member 33 as illustrated in FIG. 8B is mounted on the rear wall portion 11*b* of the condensed water storage chamber 11.

As illustrated in FIG. 8B, the partition member 33 is formed in a box shape similar with the rectangular shape having an opened top surface. In the partition member 33, notch portions 33*a* are installed in opposite sides of the left and right wall portion thereof, wherein the notch portion 33*a* has a cross-section in the U shape that is notched from the top to the lower side.

The partition member 33 is fixed by inserting two notch portions 33*a* into the lower portion of the rear wall portion 11*b*. The communication path corresponding to the first communication path according to the first embodiment is divided into a water passage 12 formed by a bottom surface 11*a* of the condensed water storage chamber 11, a bottom surface of the pump chamber 16 and an external wall portion of the partition member 33, and a ventilation path 17 formed by an internal wall portion of the partition member 33 and the rear wall portion 11*b*, as illustrated in FIGS. 7 and 8A.

The water passage 12 forms the first communication path 12 according to the second embodiment. That is, the water passage 12 is configured to allow the condensed water storage chamber 11 to be communicated with the pump chamber 16 through each bottom portion thereof, and configured to guide the condensed water W in the condensed water storage chamber 11 into the pump chamber 16.

As illustrated in FIG. 7, the ventilation path 17 forms a path in a "⊏" shape in which the upper side is opened when viewing from the left side or the right side, and is configured to vent between the condensed water storage chamber 11 and the pump chamber 16. The ventilation path 17 forms the second communication path 17 according to the second embodiment and is configured to allow the first air flow path

8*a* to be communicated with the pump chamber 16 through the condensed water storage chamber 11 so as to reduce the differential pressure between the pump chamber 16 and the condensed water storage chamber 11.

Therefore hereinafter, the water passage 12 and the ventilation path 17 will be referred to as the first communication path 12 and the second communication path 17 according to the second embodiment, or just "the first communication path 12 and the second communication path 17"

Particularly, according to the second embodiment, the rear end of the second communication path 17 is opened in the pump chamber 16 and the front end of the second communication path 17 is opened in the condensed water storage chamber 11. Accordingly, the first air flow path 8*a* is communicated with the pump chamber 16 via the condensed water storage chamber 11.

The opposite ends of the second communication path 17 are opened to the upper side and each height of the opposite ends of the second communication path 17 are higher than the height in which the first communication path 12 is opened in the pump chamber 16 and the condensed water storage chamber 11.

The opposite ends of the second communication path 17 are opened at a position higher than the threshold level L in which the pump 19 starts to operate.

According to the second embodiment, when the clothes dryer D starts to operate, the pressure in the pump chamber 16 is adjusted to be close to the negative pressure in the condensed water storage chamber 11 by the flow of air between the pump chamber 16 and the condensed water storage chamber 11 through the first communication path 12 or the second communication path 17. Meanwhile, the pressure in the condensed water storage chamber 11 is adjusted to be close to the negative pressure in the first air flow path 8*a* through the communication by the drain hole 6*b*, as illustrated in the first embodiment. As in the first embodiment, as the amount of the condensed water W accommodated in the pump chamber 16 and the condensed water storage chamber 11 increases, the first communication path 12 is closed by the condensed water W, but the second communication path 17 is configured to maintain the communication between the pump chamber 16 and the condensed water storage chamber 11. As illustrated in FIG. 7, when the first communication path 12 is submerged, the flow of air through the first communication path 12 is blocked but the flow of air through the second communication path 17 is maintained. Accordingly, the differential pressure between the pump chamber 16 and the condensed water storage chamber 11 is reduced by the flow of air through the second communication path 17. It is possible to prevent the increase of the differential pressure between the pump chamber 16 and the condensed water storage chamber 11 and to prevent the difference in the water level of the condensed water W of the condensed water storage chamber 11 and the pump chamber 16. As a result, the pump 19 can be operated normally, and the backflow and the scatter of the condensed water W can be prevented.

As described above, as in the first embodiment, the clothes dryer D according to the second embodiment is capable of more reliably preventing the backflow and the scatter of the condensed water (W) although the fan device 10 having a high air flow rate is provided. That is, it is allowed that the air flow rate of the fan device 10 provided in the clothes dryer D is increased.

Since the pump chamber 16 and the first air flow path 8*a* are communicated with each other via the condensed water storage chamber 11, as in the first embodiment, it is possible to prevent the increase of the pressure in the first air flow path 8*a* and further in the second air flow path 8*b*. Accordingly, it is possible to prevent the leakage of the air for drying in the each duct 5, 6 and 7 and to prevent the generation of the condensation caused by the leakage.

According to the second embodiment, the second communication path 17 is configured to allow the flow of air between the pump chamber 16 and the condensed water storage chamber 11 and thus it is possible not to interrupt the flow A2 of the air for dying that flows in the first air flow path 8*a*.

According to the second embodiment, the first communication path 12 and the second communication path 17 are configured by the partition member 33 mounted on the rear wall portion 11*b*, and thus it is possible to minimize the change in the design around the ducts 5, 6 and 7 forming the circulation air flow path 8, so that the commonization of parts is obtained so as to reduce the manufacturing cost.

Since the opposite ends of the second communication path 17 are provided to be higher than the first communication path 12, it is prevented that the condensed water W in the pump chamber 16 is reverse-flowed or the second communication path 17 is submerged. In addition, the communication of the second communication path 17 is maintained.

Since the opposite openings of the second communication path 17 are provided to face the upper side, it is prevented that the condensed water W in the pump chamber 16 is reverse-flowed or the second communication path 17 is submerged, and the communication of the second communication path 17 is maintained, in comparison with the configuration in which the opening of the second communication path 17 faces the lower side or the front, back, left and right directions.

Since the opposite ends of the second communication path 17 are opened in a position higher than the threshold level L in which the pump 19 starts to operate, it is prevented that the condensed water W in the pump chamber 16 is reverse-flowed or the second communication path 17 is submerged. In addition, the communication of the second communication path 17 is maintained.

First Modification of the Second Embodiment

Hereinafter a first modification of the second embodiment will be described.

As illustrated in FIGS. 9, 10A and 10B, a tube 34 is inserted and fixed in the first communication path 12, wherein the tube 34 corresponds to a tubular conduit. According to the first modification, the second communication path 17 is divided by the tube 34.

As illustrated in FIG. 9, the second communication path 17 has a cross section in a U shape when viewing from the front side, and the same as the second communication path 17 according to the second embodiment, one end of the second communication path 17 is opened in the pump chamber 16 while the other end of the second communication path 17 is opened in the condensed water storage chamber 11. The opposite ends of the second communication path 17 are opened to the upper side. Each height of the opposite ends of the second communication path 17 are higher than the height in which the first communication path 12 is opened in the pump chamber 16 and the condensed water storage chamber 11.

According to the modification, as in the second embodiment, the clothes dryer D is capable of more reliably preventing the backflow and the scatter of the condensed water (W) although the fan device 10 having a high air flow rate is provided. That is, it is allowed that the air flow rate of the fan device 10 provided in the clothes dryer D is increased.

According to the modification, the second communication path 17 is configured by the tube 34 mounted on the first communication path 12, and thus it is possible to minimize the change in the design around the ducts 5, 6 and 7 forming the circulation air flow path 8, so that the commonization of parts is obtained so as to reduce the manufacturing cost.

Second Modification of the Second Embodiment

According to the second embodiment and the first modification of the second embodiment, the second communication path 17 is configured such that one end of the second communication path 17 is opened in the pump chamber 16 while the other end of the second communication path 17 is opened in the condensed water storage chamber 11 by mounting the partition member 33 or inserting the tube 34, but is not limited thereto. For example, as illustrated in FIG. 11, the second communication path 17 is configured by installing a through-hole on the rear wall portion 11*b*.

Additional Modification of the Second Embodiment

According to the second embodiment, a member formed in a box shape similar with the rectangular shape is configured to be inserted and mounted to the rear wall portion 11*b* of the condensed water storage chamber 11 has been described as an example of the partition member 33, but is not limited thereto. For example, a space configured to push the condensed water W flowing the first communication path 12 is provided by using a wall portion standing adjacent to the first communication path 12, and the space is communicated with the condensed water storage chamber 11 and the pump chamber 16 so that the second communication path 17 is divided.

Third Embodiment

Hereinafter according to the third embodiment, a clothes dryer D will be described. As illustrated in FIGS. 12, 13A and 13B, the second communication path 17 according to the third embodiment is configured to allow the first air flow path 8*a* to be communicated with a space A except for the circulation air path to reduce the differential pressure between the condensed water storage chamber 11 and the pump chamber 16, which is different from the second communication path 17 according to the first and second embodiment.

Particularly, a through hole is installed in the rear wall portion 6*h* of the heat drying duct 6 to which the rear end of the cover base 6*a* is connected, and the rear end of the second communication path 17 divided by the through hole is opened to the atmosphere while the front end thereof is opened in the first air flow path 8*a*. Particularly, the rear end of the second communication path 17 is opened on the rear surface of the body 1 around the pump chamber 16*a*, as illustrated in FIGS. 13A and 13B and thus the first air flow path 8*a* is communicated with the space A except for the circulation air path in the body 1.

The second communication path 17 is opened in the first air flow path 8*a* in the direction downstream than the drain hole 6*b*.

According to the third embodiment, when the clothes dryer D starts to operate, the differential pressure is generated such that the pressure in the first air flow path 8*a* becomes the negative pressure and the pressure in the second air flow path 8*b* becomes the positive pressure. However, by the air flowing into the first air flow path 8*a* from the space A except for the circulation air path passing through the second communication path 17, the pressure in the first air flow path 8*a* is adjusted to be close to the atmospheric pressure. Meanwhile, the pressure in the condensed water storage chamber 11 is adjusted to be close to the atmospheric pressure by the communication with the first air flow path 8*a* through the drain hole 6*b*. The pressure in the pump chamber 16 becomes lager than the pressure in the condensed water storage chamber 11 (i.e., it is close to the atmospheric pressure) due to the communication between the pump chamber 16 and the first air flow path 8*a* through the condensed water storage chamber 11, and the air flowing into the pump chamber 16 from the outside A. However, the pressure in the condensed water storage chamber 11 is adjusted to be close to the atmospheric pressure by the installation of the second communication path 17 and thus the differential pressure between the pump chamber 16 and the condensed water storage chamber 11 is reduced.

As the amount of the condensed water W accommodated in the pump chamber 16 and the condensed water storage chamber 11 increases, the first communication path 12 is closed by the condensed water W, but the second communication path 17 is configured to maintain the communication the outside A except for the circulation air path and the first air flow path 8*a* even when the first communication path 12 is closed, as illustrated in FIG. 12. Therefore, when the first communication path 12 is submerged, the flow of air through the first communication path 12 is prevented but the flow of air through the second communication path 17 is maintained. Accordingly, although the first communication path 12 is submerged, the differential pressure between the pump chamber 16 and the condensed water storage chamber 11 is reduced. Therefore, although the first communication path 12 is submerged, it is possible to prevent the increase of the differential pressure between the pump chamber 16 and the condensed water storage chamber 11 and it is possible to prevent the difference in the water level of the condensed water W of the condensed water storage chamber 11 and the pump chamber 16. As a result, the pump 19 can be operated normally, and the backflow and the scatter of the condensed water W can more reliably be prevented.

According to the third embodiment, as in the first embodiment, the clothes dryer D is capable of more reliably preventing the backflow and the scatter of the condensed water W although the fan device 10 having a high air flow rate is provided. That is, it is allowed that the air flow rate of the fan device 10 provided in the clothes dryer D is increased.

Since the pressure in the first air flow path 8*a* and the pressure in the condensed water storage chamber 11 are is closed to the atmospheric pressure by opening the first air flow path 8*a* to the atmosphere, it may be possible to maintain the pressure in the pump chamber 16 at the atmospheric pressure. Therefore, it may be possible to reduce the load of the pump 19.

It is possible to reduce the differential pressure between the water storage tank 25 and the pump chamber 16 by maintaining the pressure in the pump chamber 16 at a relatively high pressure. Although the pressure in the pump chamber 16 becomes lower than the pressure in the water storage tank 25 by the operation of the fan device 10, it is possible to reduce the differential pressure between the water storage tank 25 and the pump chamber 16 by installing the second communication path 17. Therefore, it is possible to reduce the load of the pump 19 and to easily pump the condensed water W.

In comparison with the configuration to allow the pressure in the pump chamber 16 to be close to the negative pressure, the differential pressure between the space A except for the circulation air path and the pump chamber 16 is relatively reduced by maintaining the pressure in the pump chamber 16 at a relatively atmospheric pressure and thus it is possible to prevent the air from flowing from the outside A into the pump chamber 16. Therefore, e.g., when the first communication path 12 is not submerged, it is possible to prevent the atmosphere introduced into the pump chamber 16 from generating a wave on the surface of the condensed W in the condensed water storage chamber 11, which cause scattering of the condensed water W.

Since the first air flow path 8*a* and the space A except for the circulation air path is directly connected, the air flowing from the outside A directly flows into the first air flow path 8*a* through the second communication path 17 without passing through the condensed water storage chamber 11. Therefore, it is possible to prevent the atmosphere flowing into the pump chamber 16 from generating a wave on the surface of the condensed W in the condensed water storage chamber 11, which cause scattering of the condensed water W.

Since the first air flow path 8*a* and the space A except for the circulation air path is directly connected, it is possible to prevent the condensed water W from back-flowing via the second communication path 17 or from submerging the second communication path 17 when the water level of the condensed water W in the pump chamber 16 is increased.

Since the second communication path 17 is opened in the first air flow path 8*a* in the direct downstream than the drain hole 6*b*, the second communication path 17 is installed adjacent to the direct upstream of the fan device 10 than the drain hole 6*b*. Therefore, the differential pressure between the first air flow path 8*a* adjacent to the second communication path 17 and the space A except for the circulation air path is not relatively large, and thus it is possible to relatively immediately reduce the differential pressure between the pump chamber 16 and the condensed water storage chamber 11 by immediately allowing the pressure in the first air flow path 8*a* to be close the atmospheric pressure.

Modification of the Third Embodiment

Hereinafter a clothes dryer according to a modification of the third embodiment will be described.

According to the third embodiment, the second communication path 17 is configured to be opened to the outside of the body 1, as illustrated in FIGS. 12, 13A and 13B but according to the modification, the second communication path 17 is configured to be opened inside of the body 1, as illustrated in FIG. 14. Accordingly, the second communication path 17 is not opened to the rear surface of the body 1, as illustrated in FIG. 15.

Fourth Embodiment

Hereinafter according to the fourth embodiment, a clothes dryer D will be described. As illustrated in FIG. 16, the second communication path 17 according to the fourth embodiment is configured to allow the first air flow path 8*a* to be communicated with a space A except for the circulation air path in the body 1 to reduce the differential pressure between the condensed water storage chamber 11 and the pump chamber 16.

Particularly, a through hole is installed in a rear wall portion 11*h* of the condensed water storage chamber 11. The rear end of the second communication path 17 divided by the through hole is opened to the atmosphere while the front end thereof is opened in the condensed water storage chamber 11. Particularly, the rear end of the second communication path 17 is opened on the rear surface of the body 1 around the pump chamber 16, as illustrated in FIG. 16 and thus the first air flow path 8*a* is communicated with the space A except for the circulation air path in the body 1.

A height in which the second communication path 17 is opened in the condensed water storage chamber 11 is higher than a height in which the first communication path 12 is opened in the condensed water storage chamber 11, and the height is higher than the threshold level L in which the pump 19 starts to operate.

According to the fourth embodiment, when the clothes dryer D starts to operate, the differential pressure is generated such that the pressure in the first air flow path 8*a* becomes the negative pressure and the pressure in the second air flow path 8*b* becomes the positive pressure. However, by the air flowing from the space A except for the circulation air path to the condensed water storage chamber 11 by passing through the second communication path 17, the pressure in the condensed water storage chamber 11 is adjusted to be close to the atmospheric pressure. The pressure in the pump chamber 16 becomes lager than the pressure in the condensed water storage chamber 11 (i.e., it is close to the atmospheric pressure) due to the communication between the pump chamber 16 and the first air flow path 8*a* through the condensed water storage chamber 11, and the air flowing into the pump chamber 16 from the outside A, as in the third embodiment. However, the pressure in the condensed water storage chamber 11 is adjusted to be close to the atmospheric pressure by the installation of the second communication path 17 and thus the differential pressure between the pump chamber 16 and the condensed water storage chamber 11 is reduced.

As the amount of the condensed water W accommodated in the pump chamber 16 and the condensed water storage chamber 11 increases, the first communication path 12 is closed by the condensed water W, as illustrated in FIG. 16, but the second communication path 17 is configured to maintain the communication the outside A except for the circulation air path and the first air flow path 8*a* even when the first communication path 12 is closed, as in the first to third embodiments. Therefore, when the first communication path 12 is submerged, the flow of air through the first communication path 12 is prevented but the flow of air through the second communication path 17 is maintained. Accordingly, although the first communication path 12 is submerged, the differential pressure between the pump chamber 16 and the condensed water storage chamber 11 is reduced. It is possible to prevent the difference in the water level of the condensed water W of the condensed water storage chamber 11 and the pump chamber 16 and to prevent the increase of the differential pressure between the pump chamber 16 and the condensed water storage chamber 11. As a result, the pump 19 can be operated normally, and it is possible to more reliably prevent the backflow and the scatter of the condensed water W.

As in the first embodiment, the clothes dryer D according to the fourth embodiment is capable of more reliably preventing the backflow and the scatter of the condensed water (W) although the fan device 10 having a high air flow rate is provided. That is, it is allowed that the air flow rate of the fan device 10 provided in the clothes dryer D is increased.

Since the pressure in the condensed water storage chamber 11 is close to the atmospheric pressure by opening the condensed water storage chamber 11 to the atmosphere, it may be possible to maintain the pressure in the pump chamber 16 at the atmospheric pressure. Therefore, it may be possible to reduce the load of the pump 19 as in the third embodiment.

As in the third embodiment, the differential pressure between the space A except for the circulation air path and the pump chamber 16 is reduced and thus it is possible to prevent the air from flowing from the outside A into the pump chamber 16. Therefore, e.g., when the first communication path 12 is not submerged, it is possible to prevent the atmosphere introduced into the pump chamber 16 from generating a wave on the surface of the condensed W in the condensed water storage chamber 11, which cause scattering of the condensed water W.

According to the fourth embodiment, the second communication path 17 is configured to allow the air to flow between the space A except for the circulation air path and the condensed water storage chamber 11, and thus it is possible not to interrupt the flow A2 of the air for dying that flows in the first air flow path 8*a*.

The height in which the second communication path 17 is opened in the condensed water storage chamber 11 is higher than the height in which the first communication path 12 is opened in the condensed water storage chamber 11, and the height is higher than the threshold level L in which the pump 19 starts to operate. Therefore, it is possible to prevent the condensed water W in the condensed water storage chamber 11 from flowing in the second communication path 17 or to prevent the second communication path 17 from being submerged. In addition, it is possible to maintain the communication by the second communication path 17.

Modification of the Fourth Embodiment

Hereinafter a clothes dryer according to a modification of the fourth embodiment will be described.

According to the fourth embodiment, the second communication path 17 is configured to be opened to the outside of the body 1, as illustrated in FIG. 16, but according to modification, the second communication path 17 is configured to be opened inside of the body 1, instead of the configuration thereof.

Another Embodiment

A common modification of the above-described embodiments will be described.

In each embodiment, it is possible to properly adjust an area of the flow path area or a length of the flow path of the first communication path 12, the second communication path 17 and the drain hole 6*b*. Accordingly, it is possible to adjust the size of the differential pressure among the pump chamber 16, the condensed water storage chamber 11 and the first air flow path 8*a*. Therefore, the pressure in the condensed water storage chamber 11 may be lower than the pressure in the pump chamber 16. In this case, although the water level of the condensed water storage chamber 11 is higher than the water level of the pump chamber 16, the pump 19 is properly operated according to the detection result of the clothes inlet 2 and thus it is prevent the backflow and scatter of the condensed water W.

The second communication path 17 may be configured by combining the second communication path 17 according to the first to fourth embodiments.

The shape and the configuration of the second communication path 17 according to the first to fourth embodiments are not limited thereto. For example, in the fourth embodiment, the condensed water storage chamber 11 and the space A except for the circulation air path may be communicated with each other by a tube inserted into the rear wall portion 11*b* instead of the through hole.

A mesh type member may be mounted to the opening of the second communication path 17 to prevent the foreign material from entering to the pump chamber 16, the condensed water storage chamber 11 and the first air flow path 8*a*.

An openable control valve may be installed in the second communication path 17. In this case, the control valve is configured to be opened or closed by the water level and the air pressure of the pump chamber 16 or the condensed water storage chamber 11, and the control valve is configured to be closed until a predetermined time is expired after the drying process starts.

As illustrated in FIG. 6, a rear side covering portion 36 that is separated from the covering portion 18 closing the pump chamber may be mounted to the rear surface of the body 1. The rear side covering portion 36 may be removable the same as the covering portion 18, and thus it is possible to improve the air tightness and to prevent foreign matters from entering into the pump chamber 16. When the rear end of the second communication path 17 is opened on the rear surface of the body 1 as illustrated in the third and fourth embodiments, it is possible to prevent foreign matters from entering into the first air flow path 8*a* and the condensed water storage chamber 11 through the second communication path 17 by installing the rear side covering portion 36.

The number, arrangement and shape of the drain hole 6*b* may vary. For example, it is possible to install another drain hole in the direct lower portion of the evaporator 9*a* or the condenser 9*b*.

According to the above mentioned embodiment, the opening 15 of the pump chamber 16 is closed by the removable covering portion 18, but is not limited thereto. For example, the covering portion 18 and the pump chamber 16 are integrally formed.

The other end of the water lift hose 20 may be connected to a component other than the water storage tank 25. For example, the water lift hose 20 may be directly connected to the discharge pipe of the house, and it is possible to discharge the water through discharge pipe. The water level sensor 21 is not limited to the float type, and thus various sensors may be used. For example, it is possible to use the electrode sensor.

In the first to fourth embodiments, the evaporator 9*a* and the condenser 9*b* forming the heat pump cycle 9 is used as the cooler and the heater, but is not limited thereto. For example, an air cooled heat exchanger 27 may be used instead of the evaporator 9*a* as illustrated in FIG. 5 and an electric heater 28 may be used instead of the condenser 9*b*. In this case, the electric heater 28 may be installed in the second air flow path 8*b* and thus it is possible to prevent the electric heater 28 from effecting to the operation of the air cooled heat exchanger 27.

In the first to fourth embodiments, the clothes dryer D configured to dry the clothes C, but is not limited thereto. Things other than the clothes may be an object to be dried.

Although the embodiments of the present disclosure have been shown and described, it would be appreciated by those skilled in the art that changes may be made in these embodiments without departing from the principles and spirit of the present disclosure, the scope of which is defined in the claims and their equivalents.

The invention claimed is:

1. A clothes dryer comprising:

a body;

a drum provided inside of the body;

a fan device configured to circulate air supplied to the drum;

a circulation air flow path communicated with the drum and in which the air is circulated by the fan device;

a cooling device configured to dehumidify the air by cooling the air in the circulation air flow path;

a condensed water storage chamber communicated with the circulation air flow path and configured to store condensed water generated by the cooling device;

a pump chamber communicated with an outside space of the circulation air flow path and configured to accommodate a pump pumping the condensed water;

a first communication path configured to flow the condensed water stored in the condensed water storage chamber to the pump chamber by allowing the condensed water storage chamber to be communicated with the pump chamber; and a second communication path opened into the circulation air flow path and configured to allow the circulation air flow path to be communicated with at least one of the pump chamber and the outside space of the circulation air flow path.

2. The clothes dryer of claim 1, wherein the circulation air flow path comprises a first air flow path communicated with the condensed water storage chamber to allow the air passed through the drum to flow to the fan device, and a second air flow path provided to allow the air passed through the fan device to flow to the drum.

3. The clothes dryer of claim 2, wherein the second communication path maintains at least one communication among the first air flow path, the pump chamber and the outside space of the circulation air flow path, when the first air flow path is closed by the condensed water since the condensed water stored in the pump chamber is increased.

4. The clothes dryer of claim 1, wherein an opening of the second communication path is provided in a position higher than a position in which the first communication path is provided.

5. The clothes dryer of claim 2, wherein one end of the second communication path is opened in the pump chamber and other end of the second communication path is opened in the first air flow path.

6. The clothes dryer of claim 5, further comprising:

a drain portion configured to allow the condensed water storage chamber to be communicated with the first air flow path, wherein the second communication path is closer to the fan device than the drain portion.

7. The clothes dryer of claim 2, wherein one end of the second communication path is opened in the pump chamber and other end of the second communication path is opened in the condensed water storage chamber so that the pump chamber is communicated with the first air flow path through the condensed water storage chamber.

8. The clothes dryer of claim 7, wherein the second communication path is provided in a position higher than a position in which the first communication path is opened in the condensed water storage chamber.

9. The clothes dryer of claim 7, wherein a portion of the second communication path penetrates the first communication path.

10. The clothes dryer of claim 9, wherein the second communication path is formed in a tubular shape, and the second communication path comprises a curved portion so that the curved portion penetrates the first communication path.

11. The clothes dryer of claim 9, wherein a partition member is provided in the first communication path to partition the first communication path, and thus the second communication path is provided between the first communication path by the partition member.

12. The clothes dryer of claim 2, wherein one end of the second communication path is opened in the first air flow path and other end of the second communication path is opened in an outside and an inside of the body.

13. The clothes dryer of claim 2, wherein the second communication path is closer to the fan device than a drain portion configured to allow the condensed water storage chamber to be communicated with the first air flow path.

14. The clothes dryer of claim 2, wherein one end of the second communication path is opened in the condensed water storage chamber and the other another end of the second communication path is opened to an outside space of the body so that the first air flow path is communicated with the outside space of the body through the condensed water storage chamber.

15. The clothes dryer of claim 1, wherein the pump chamber comprises an opening opened to an atmosphere, and a covering portion removably provided to close the opening of the pump chamber.

16. The clothes dryer of claim 1, further comprising:

a water storage tank storing condensed water pumped from the pump chamber; and a connecting waterway connecting the pump and the water storage tank, wherein the pump chamber is communicated with the outside space of the circulation air flow path through the connecting waterway.

17. A clothes dryer comprising:

a drum;

a circulation air flow path communicated with the drum and configured to allow air to be circulated, the circulation air flow path provided with a first air flow path configured to allow the air passed through the drum to be cooled and dehumidified, and a second air flow path configured to allow the dehumidified air to flow to the drum;

a condensed water storage chamber communicated with the first air flow path and configured to store condensed water generated by a cooling device;

a pump chamber configured to receive condensed water stored in the condensed water storage chamber and including a pump configured to pump condensed water, the pump chamber communicated with an outside space of the circulation air flow path; and at least one communication path configured to introduce air to at least one of the first air flow path and the pump chamber to reduce a pressure difference between the condensed water storage chamber and the pump chamber.

18. The clothes dryer of claim 17, wherein in order to reduce a pressure in the pump chamber by flowing the air to the pump chamber, one end of the at least one communication path is opened in the pump chamber and an other end of the at least one communication path is opened in at least one of an inside of the first air flow path and the condensed water storage chamber.

19. The clothes dryer of claim 17, wherein in order to increase a pressure in the condensed water storage chamber by flowing the air to the condensed water storage chamber, one end of the at least one communication path is opened in the first air flow path and an other end of the at least one communication path is communicated with at least one of an inside of the pump chamber and an outside of the circulation air flow path.

20. The clothes dryer of claim 19, wherein one end of the at least one communication path is opened in the condensed water storage chamber to be communicated with the first air flow path and an other end of the at least one communication path is communicated with the outside of the circulation air flow path.

* * * * *